United States Patent [19]

Ray

[11] 4,365,994

[45] Dec. 28, 1982

[54] COMPLEX BORIDE PARTICLE CONTAINING ALLOYS

[75] Inventor: Ranjan Ray, Randolph, N.J.

[73] Assignee: Allied Corporation, Morristown, N.J.

[21] Appl. No.: 23,379

[22] Filed: Mar. 23, 1979

[51] Int. Cl.[3] ..... C22C 38/08; C22C 38/10; C21D 6/00

[52] U.S. Cl. ..... 75/123 B; 148/12.1; 148/13; 148/13.1; 148/425; 148/427; 148/403

[58] Field of Search ..... 75/134 P, 134 F, 123 B; 148/12.1, 13, 13.1

[56] References Cited

U.S. PATENT DOCUMENTS

| | | | |
|---|---|---|---|
| 3,341,337 | 9/1967 | Quaas et al. | 75/134 F X |
| 3,970,445 | 7/1976 | Gale et al. | 75/126 P |
| 4,134,779 | 1/1979 | Ray et al. | 75/123 B |
| 4,152,146 | 5/1979 | Freilich et al. | 75/123 B |

FOREIGN PATENT DOCUMENTS

| | | | |
|---|---|---|---|
| 2817643 | 11/1978 | Fed. Rep. of Germany | 75/134 F |
| 2826627 | 1/1979 | Fed. Rep. of Germany | 75/123 B |
| 273640 | 6/1970 | U.S.S.R. | 75/126 P |
| 357254 | 1/1973 | U.S.S.R. | 75/134 F |
| 447455 | 10/1974 | U.S.S.R. | 75/123 B |

*Primary Examiner*—F. Edmundson

*Attorney, Agent, or Firm*—Ernest D. Buff; Gerhard H. Fuchs

[57] ABSTRACT

Boron-containing transition metal alloys based on one or more of iron, cobalt and nickel, and containing at least two metal components, are characterized by being composed of ultrafine grains of a primary solid-solution phase randomly interspersed with particles of complex borides which are predominantly located at the junctions of at least three grains of the primary solid-solution phase. These alloys are obtained by devitrification of the solid, amorphous state under specific heat-treatment conditions. These alloys can be consolidated into three-dimensional bodies.

36 Claims, 6 Drawing Figures

0.2 μ

COMPLEX BORIDE PARTICLE CONTAINING ALLOYS

DESCRIPTION

1. Field of the Invention

The invention relates to crystalline alloy compositions having ultrafine grain structure obtained from glassy metal alloys as starting materials.

2. Description of the Prior Art

Amorphous metal alloys and articles made therefrom are disclosed by Chen and Polk in U.S. Pat. No. 3,856,513 issued Dec. 24, 1974. This patent discloses novel metal alloy compositions which can be rapidly quenched to the glassy (amorphous) state and which, in that state, have properties superior to such alloys in the crystalline state. This patent discloses that powders of such glassy metals with particle size ranging from about 0.001 to 0.025 cm can be made by atomizing the molten alloy to droplets of this size, and then quenching these droplets in a liquid such as water, refrigerated brine or liquid nitrogen.

It is also known that glassy metal alloys crystallize and turn brittle upon heating above their crystallization temperature. By differential thermal analysis (DTA) measurement, the crystallization temperature ($T_x$) can be determined by heating the glassy (amorphous) alloy at the rate of about 20° C. to 50° C. per minute and noting the temperature at which excess heat is evolved, which is the crystallization temperature. During that determination, one may also observe absorption of excess heat over a particular temperature range, which is called the glass transition temperature. In general, the case of glassy metal alloys the less well defined glass transition temperature will fall within the range of from about 50° C. below the crystallization temperature and up to the crystallization temperature. The glass transition temperature ($T_g$) is the temperature at which an amorphous material (such as glass or a high polymer) changes from a brittle vitreous state to a plastic state.

It is known that the metalloids boron and phosphorus are only sparingly soluble in transition metals such as Fe, Ni, Co, Cr, Mo, W, etc. Alloys of transition metals containing significant quantities of boron and/or phosphorus, say up to about 20 atom percent of boron and/or phosphorus prepared by conventional technology have no practical engineering uses because they are extremely brittle due to presence of a brittle and massive eutectic phase of brittle borides and/or phosphides around the primary grain boundaries. Since boron and phosphorus are only sparingly soluble in transition metals, any excess of boron and/or phosphorus beyond that which is soluble will precipitate out as a eutectic phase of brittle borides and/or phosphides, which is then deposited at the grain boundaries.

The presence of these hard borides and/or phosphides in such alloys could be advantageous, if they could be made to exist as fine dispersoids in the matrix metals, in the manner in which certain precipitates are dispersed in precipitation/age-hardened and/or dispersion-hardened alloys. In conventional processing techniques for precipitation and dispersion hardening of alloys, e.g., of plain carbon steels, alloy steels, Ni, Fe, Co base superalloys, Al and Cu base alloys and many other important engineering alloys, hardening results from precipitation of an intermetallic phase in finely dispersed form between the grain boundaries. In general, the following steps are involved in thermal precipitation hardening of such alloys: the alloy is heated to high temperature so that solute elements are taken into solid solution, and the heated alloy is then quenched to retain solute elements in a supersaturated solid solution phase. Thereafter, and optionally, a suitable heat treatment may be employed to cause some or most of the solute elements to form a strong intermetallic phase uniformly dispersed within the matrix as fine particles or platelets. Such conventional precipitation hardening techniques require a certain minimum amount of solid solubilities of the solute element in the base metals.

Conventional techniques as above described cannot be applied to transition metal alloys containing boron and phosphorus, since these metalloids have insufficient solubilities in the transition metal alloys, and the resultant products are relatively coarse grained brittle materials having little practical value.

SUMMARY OF THE INVENTION

The present invention provides boron-containing transition metal alloys, based on iron, cobalt and/or nickel, containing at least two metal components, said alloy consisting of ultrafine grains of a primary solid solution phase, randomly interspersed with particles of complex borides. Typically, the complex boride particles are predominantly located at the junctions of at least three grains of said ultrafine grain solid solution phase. The term "based on iron, cobalt and/or nickel" means that these alloys contain at least 30 atom percent of one or more of iron, cobalt and/or nickel.

The term "alloy" is used herein in the conventional sense as denoting a solid mixture of two or more metals (Condensed Chemical Dictionary, Ninth Edition, Van Norstrand Reinhold Co. New York, 1977). These alloys additionally contain admixed at least one nonmetallic element, namely boron.

The terms glassy metal alloy, metallic glass, amorphous metal alloy and vitreous metal alloy are considered equivalent as employed herein.

It has been found that certain boron-containing transition metal alloys—which, if conventionally cooled from the liquid state to the crystalline solid state, form relatively coarse grained brittle materials having little practical value—can be obtained in the above-described ultra-fine grained crystalline morphology having a combination of desirable hardness, strength and ductility properties if they are first rapidly quenched from the melt to the glassy (amorphous) solid state, and are then heated at within certain specific temperature ranges for time sufficient to effect devitrification and formation of the above-described specific microstructure, characterized in that complex boride particles are formed which, typically, are predominantly located at the junctions of at least three grains of the primary solid solution phase. This is in contrast to the morphology obtained by cooling from the liquid state directly to the solid crystalline state, in which case the complex borides which precipitate are formed along the grain boundaries, rather than as individual particles, typically located at the juncture of at least three grain boundaries, as a result of which the alloy crystallized directly from the melt is extremely brittle, hence useless for most practical applications. "Predominantly located at the junction of at least three grains" means that at least fifty percent or more of the complex boride particles are located at the junctions of at least three grains of the primary solid solution phase.

In general, the complex boride particles have a nonmetal content of from about 14 to about 50 atomic percent.

In alloys of the present invention having the above-described morphology, the grains of the primary solid solution phase as well as the complex boride particles can be, and desirably are, obtained in ultra-fine particle size. Desirably, said grains have an average largest diameter of less than about 3 microns, more desirably of less than about 1 micron, and said complex boride particles have average largest diameter of less than about 1 micron, more desirably of less than about 0.5 micron, as viewed on a microphotograph of an electron microscope. The average largest diameter of the ultra-fine grains of the primary solid solution phase, as well as that of the complex boride particles, are determined by measuring, on a microphotograph of an electron microscope, the diameter of the grains and particles, respectively, in the largest dimension and averaging the values thus determined.

Suitable alloys include those having the composition of the formula $$R_uR'_vCr_wM_xB_y(P,C,Si)_z \quad (A)$$

wherein

R is one of iron, cobalt or nickel;

R' is one or two of iron, cobalt or nickel other than R;

Cr, B, P, C and Si respectively represent chromium boron, phosphorus, carbon and silicon;

M is one or more of molybdenum, tungsten, vanadium, niobium, titanium, tantalum, aluminum, tin, germanium, antimony, beryllium, zirconium, manganese and copper;

u, v, w, x, y and z represent atom percent of R, R', Cr, M, B and (P,C,Si), respectively, and have the following values:

$u=30-85$
$v=0-30$
$w=0-45$
$x=0-30$
$y=5-12$
$z=0-7.5$ with the provisos that (1) the sum of $v+w+x$ is at least 5; (2) when x is larger than 20, then w must be less than 20; (3) the amount of each of vanadium, manganese, copper, tin, germanium, antimony and magnesium may not exceed 10 atom percent; and (4) the combined amount of boron, phosphorus, carbon and silicon may not exceed about 13 atom percent. Glass-forming alloys such as those alloys of the aforestated composition can be obtained in glassy (amorphous) state, or in predominantly glassy state (containing up to about 50 percent crystalline phases, as determined by X-ray diffractometry), by any of the known methods for making glassy metal alloys, for example by rapid quenching from the melt at rates in the order of $10^{4°}$ to $10^{6°}$ K. or higher, as can be achieved by many known methods such as the splat cooling method, the hammer and anvil method, various melt spinning methods and the like.

Metallic glass bodies of the aforestated composition are then heated to temperatures of from about 0.6 to about 0.95 of the solidus temperature in degrees centigrade, but above the crystallization temperature ($T_x$) of the metallic glass composition, to be converted into a devitrified, crystalline, ductile precipitation hardened multiphase alloy having high tensile strength, generally of at least about 180,000 psi, and high hardness.

The required heating time depends upon the temperature used and may range from about 0.01 to about 100 hours, more usually from about 0.1 to about 1 hour, with higher temperatures requiring shorter heating times.

The devitrified alloys consist of ultrafine grains of a primary solid solution phase. In the most desirable embodiment, the ultrafine grains have an average diameter, measured in its longest dimension, of less than about 1 micron (1/1000 mm; 0.000039 inch), randomly interspersed with particles of complex borides, said complex boride particles having average particle size, measured in the largest dimension, of less than about 0.5 micron (0.0005 mm, 0.000019 inch), and said complex boride particles being predominantly located at the junctions of at least three grains of said ultrafine grain solid solution phase, as viewed on an electron microphotograph. Usually, the ultra-fine grains of the primary solid solution phase are of body centered cubic (bcc), face centered cubic (fcc), or of hexagonal close packed (hcp) structure. The excellent physical properties of the devitrified alloy are believed to be due to that particular microstructure. If the alloys additionally contain one or more of phosphorus, carbon and silicon, then mixed compounds containing carbon, phosphorus and/or silicon (e.g., carbides, phosphides and/or silicides) will also precipitate and will be randomly interspersed in the primary solid solution phase, and will have an average largest particle diameter of less than about 0.5 micron.

The alloys such as those of the above-stated formula (A) in glassy or predominantly glassy state as obtained by rapid quenching from the melt have at least one small dimension (typically less than about 0.1 millimeter), in order to obtain sufficiently high quench rates required for obtainment of the glassy state, and are usually obtained in the form of filament. For purposes of the present invention, a filament is a slender body whose transverse dimensions are much less than its length. In that context, filaments may be bodies such as ribbons, strips, sheets or wire, of regular or irregular cross-section. Devitrified in accordance with the present invention, these materials will find many applications where their strength can be utilized to advantage, e.g. in reinforcing composites.

Furthermore, it is possible to consolidate glassy metal alloy bodies which can be devitrified to form the above-described alloys having certain ultrafine micro-structure of the present invention, including those having the composition of the above-stated formula (A) in form such as ribbons, wire, filaments, flake, and powder by suitable thermomechanical processing techniques under simultaneous application of pressure and heat at temperatures above about 0.6 $T_s$ but below about 0.95 $T_s$ into fully dense three dimensional structural parts having the above-described ultra-fine grain structure. Such consolidated products can be obtained in any desired shaped such as discs, cylinders, rings, flat bars, plates, rods, tubes, and any other geometrical form. The consolidated parts can be given additional thermal and/or thermomechanical treatment to achieve optimum microstructure and mechanical properties. Such consolidated products have numerous high strength engineering applications, both at room temperature as well as at elevated temperatures, where their strength may be advantageously employed. Preferably such alloy bodies have a thickness of at least 0.2 millimeter, measured in the shortest dimension.

The devitrified products of the present invention obtained by heat treatment of glassy metal alloy bodies are almost as strong and hard ad the corresponding glassy metal alloy bodies from which they are obtained, and much harder than steel strips or any conventional metallic strip. In addition, they have much better thermal stability than the corresponding glassy metal alloy bodies.

DETAILED DESCRIPTION OF THE INVENTION AND OF THE PREFERRED EMBODIMENTS

Figure 1:
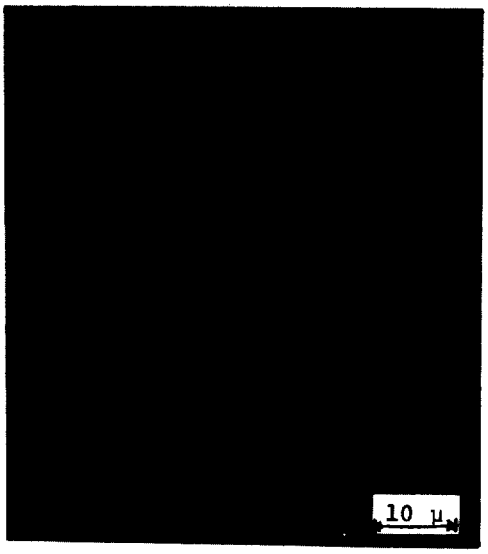
FIG. 1 is a metallographic micro photograph showing fine-grained microstructure of a crystalline $Ni_{45}Co_{20}Fe_{15}Mo_{12}B_8$ alloy devitrified from the glassy state at 950° C. for 30 minutes.
Figure 2:
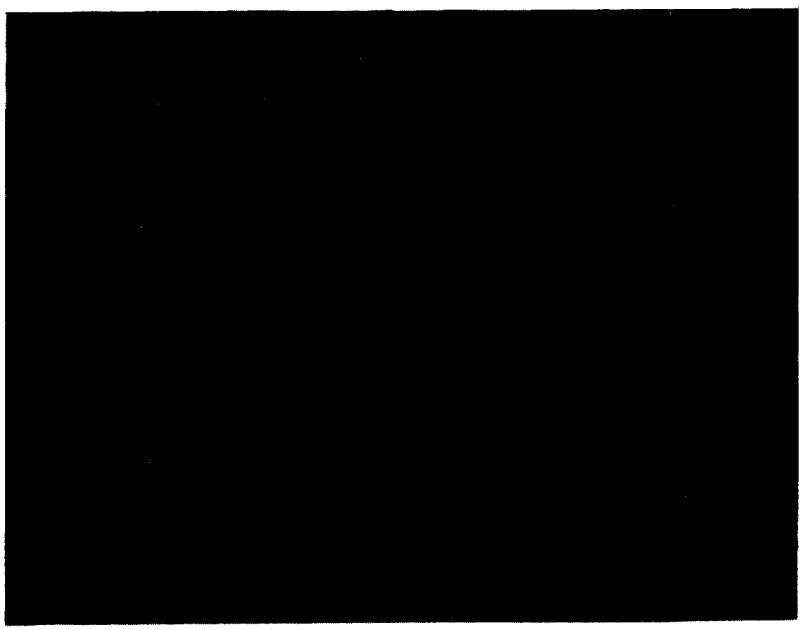
FIG. 2 is a bright field transmission electron micrograph showing fine-grained microstructure of a crystalline $Ni_{45}Co_{20}Fe_{15}W_6Mo_6B_8$ alloy devitrified from the glassy state at 950° C. for 30 minutes. The lighter colored grains are the primary solid solution phase, while the darker colored grains are the complex boride particles.
Figure 3:
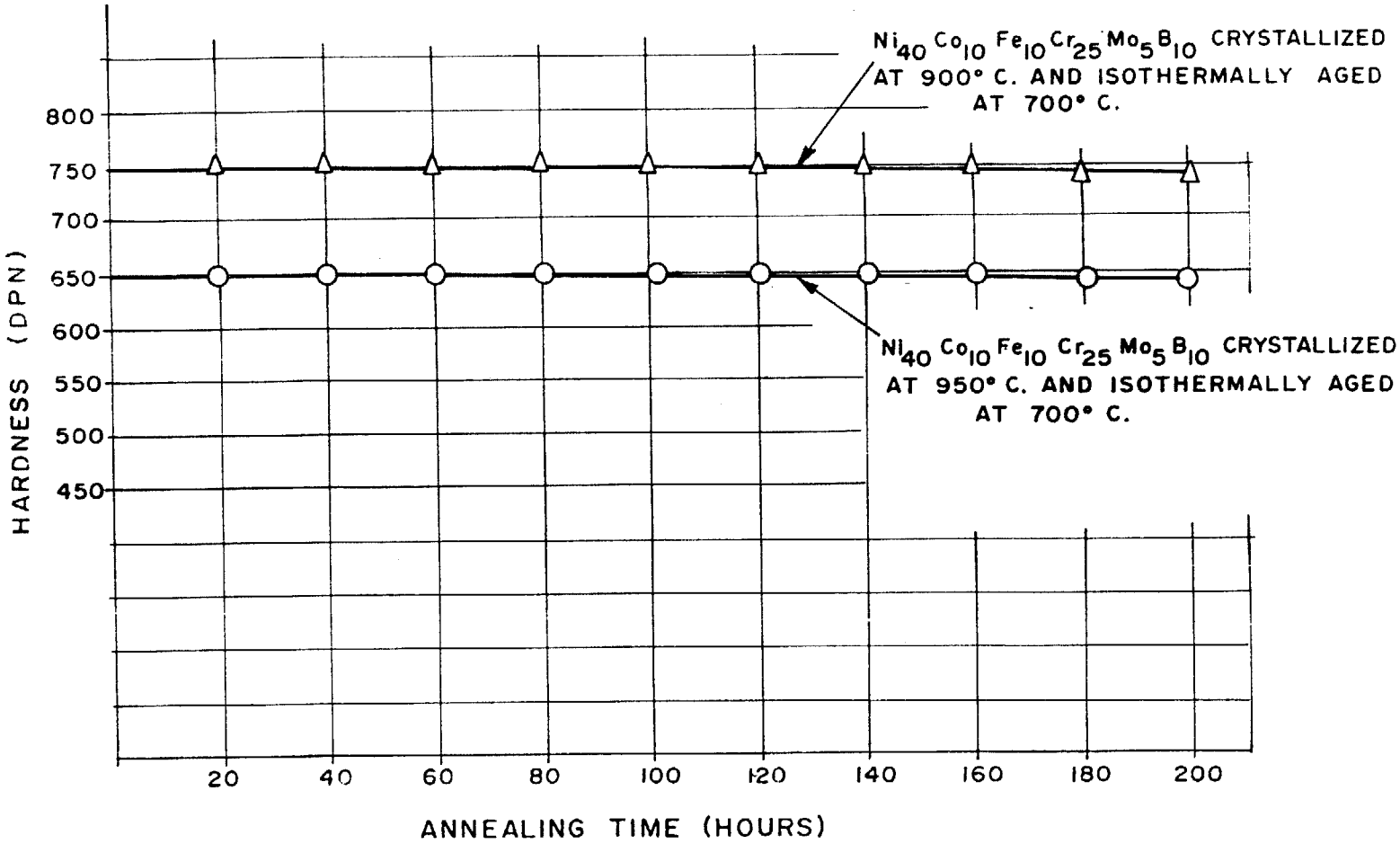
FIG. 3 is a schematic diagram showing the hardness versus annealing time at 700° C. of an alloy $Ni_{40}Co_{10}Fe_{10}Cr_{25}Mo_5B_{10}$ devitrified at 950° C. and 900° C., followed by isothermal aging at 700° C. for different lengths time.
Figure 4:
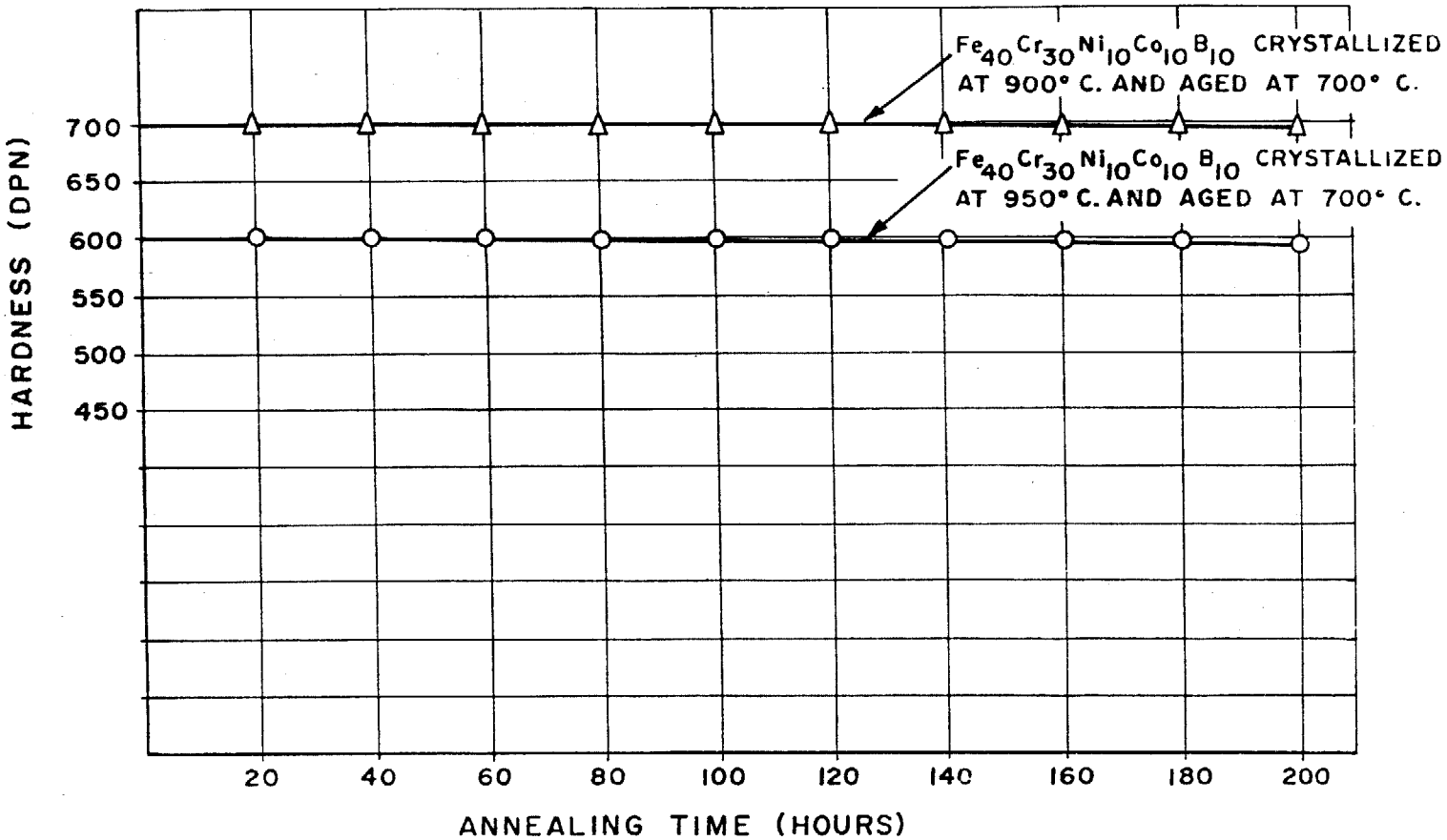
FIG. 4 is a schematic diagram showing the hardness versus annealing time at various annealing temperatures of an alloy $Fe_{40}Cr_{30}Ni_{10}Co_{10}B_{10}$ devitrified at 950° C. and subsequently aged at 700° C. and 800° C. for different lengths of time.

The crystalline phases of the metallic glass bodies including those having composition of formula A, above, which have been devitrified in accordance with the process of the present invention by heating to temperature of from about 0.6 to about 0.95 of the solidus temperature, but above the crystallization temperature, as above described, can be metastable or stable phases, depending on the compositions and heat treatments of the glassy alloys. The morphology i.e. size, shape and dispersion of various crystalline phases and respective volume fractions will depend on alloy compositions and heat treatments. For alloys of specific compositions, the microstructural characteristics of the devitrified alloys will change with different heat treatment conditions. The mechanical properties, i.e. tensile strength, ductility and hardness of the devitrified alloys depend strongly on their microstructure.

Addition of refractory metals, such as Mo, W, Nb or Ta up to about 30 atom percent, preferably up to about 20 atom percent, and/or of chromium up to 45 atom percent in the alloys generally improves the physical properties (strength, hardness) as well as the thermal stability and/or oxidation and corrosion resistance of the crystalline alloys. Alloy compositions of formula (A), above, containing from about 1 to 15 atom percent, more desirably from about 2 to 10 atom percent of one or more of Mo, W, Nb, Ta, more desirably of Mo and/or W, are a preferred class of alloys.

A preferred type of metallic glasses which can be converted by heat treatment in accordance with the method of this invention into devitrified, crystalline alloys having high tensile strength and high thermal stability are alloys having the composition (in atom percent) of the formula $$R_{30-75}R'_{10-30}Cr_{0-30}M_{0-15}B_{5-12}(P,C,Si)_{0-2.5} \quad (B)$$

wherein R is one of the elements of the group consisting of Fe, Ni and Co; R' is one or two elements of the group consisting of Fe, Ni and Co other than R; M is an element of the group consisting of Mo, W, Nb and Ta; and wherein the sum of Cr, R' and M must be at least 12 atom percent. The boron content is 80 atom percent or more of the combined metalloid content (B, P, C and Si) in the alloy. Exemplary preferred alloy compositions of the above formula (B) include $Fe_{40}Ni_{10}Co_{10}Cr_{30}B_{10}$, $Fe_{50}Cr_{25}Ni_{10}Mo_5B_{10}$, $Fe_{39}Cr_{25}Ni_{15}Co_{10}Mo_3W_2B_6$, $Fe_{45}Cr_{20}Ni_{15}Mo_{12}B_8$, $Ni_{39}Cr_{25}Fe_{15}Co_{10}Mo_3W_2B_6$, $Ni_{57}Fe_{10}Co_{15}W_6Ta_6B_6$, $Ni_{45}Co_{20}Fe_{15}W_6Mo_6B_8$, $Co_{55}Fe_{15}Ni_{10}W_6B_8$, $Co_{65}Fe_{10}Ni_{10}Mo_7B_8$ and $Co_{50}Ni_{20}Fe_{22}B_8$.

The melting temperatures of the alloys of formula (B) above, generally range from about 1150° C. to 1400° C. The glassy alloy of the above formula (B), e.g. in ribbon form, when heat treated at temperatures of from about 0.60 to about 0.95 $T_s$ for a period of time of from 0.01 to 100 hours are converted into ductile crystalline bodies, e.g. ribbons having high tensile strength. Tensile strength values of these devitrified crystalline alloy bodies typically range from 250 to 350 Kpsi, depending on alloy compositions and heat treatment.

Another preferred type of metallic glasses which can be converted by heat treatment in accordance with the method of this invention into devitrified crystalline alloys having high tensile strength and high thermal stability are iron-based compositions having the formular (in atom percent)

$$Fe_{30-80}Cr_{0-40}(Co,Ni)_{0-20}(Mo,W)_{0-20}B_{5-12}(P,C,Si)_{0-2.5} \quad (C)$$

wherein the sum of Cr, Co, Ni, Mo and/or W cannot be less than 10 atom percent; and when the content of Mo and/or W is less than 10 atom percent, then the Cr content must be equal to or more than 8 atom percent. The maximum combined metalloid content (B,C,P,Si) should not exceed about 12 atom percent. Alloys of the above formula (C) having chromium content above about 25 atom percent have excellent oxidation and corrosion resistance at elevated temperatures. Exemplary alloys of the above category include: $Fe_{60}Cr_{30}B_{10}$, $Fe_{70}Cr_{20}B_{10}$, $Fe_{40}Ni_{10}Co_{10}Cr_{30}B_{10}$, $Fe_{63}Cr_{12}Ni_{10}Mo_3B_{12}$, $Fe_{70}Ni_5Cr_{12}Mo_3B_{10}$, $Fe_{70}Cr_{10}Mo_5Ni_5B_{10}$, $Fe_{50}Cr_{25}Ni_{10}Mo_5B_{10}$, $Fe_{39}Cr_{25}Ni_{15}Co_{10}Mo_3W_2B_6$, $Fe_{10}Cr_{20}Mo_2B_8$, $Fe_{45}Co_{20}Ni_{15}Mo_{12}B_8$, $Fe_{68}Cr_{10}Mo_{12}B_{10}$, $Fe_{64}Cr_{10}Mo_{16}B_{10}$, $Fe_{75}Cr_8Mo_5W_2B_{10}$, $Fe_{67}Cr_{10}Mo_{13}B_8$, $Fe_{63}Cr_{22}Ni_3Mo_2B_8C_2$, $Fe_{63}Cr_{12}Ni_{10}Mo_3B_{12}$, $Fe_{71}Cr_{15}Mo_4B_{10}$, $Fe_{80}Cr_8Mo_2B_{10}$, $Be_{75}Cr_{10}Mo_5B_{10}$, $Fe_{74}Cr_{13}Ni_2Mo_1B_9Si_1$, $Fe_{73.5}Cr_{14.5}Ni_1Mo_1B_{10}$, $Fe_{72.5}Cr_{16}Mo_{1.5}B_{10}$, $Fe_{73.5}Cr_{15}Mo_{1.5}B_8Si_2$ and $Fe_{50}Cr_{40}B_{10}$.

Glassy bodies, e.g., ribbons of alloys of formula (C) above, when heat treated in accordance with the method of the invention, say at temperatures within the range 800°-950° C. for 0.1 to 10 minutes are converted into ductile crystalline bodies, e.g. ribbons. Ultimate tensile strength values of these devitrified bodies, e.g. ribbons, may vary from 250 to 350 kpsi, depending on alloy composition and heat treatment cycle. Besides, these crystalline bodies have remarkably high thermal stability, as compared to that of the corresponding metallic glass bodies. Typically, the crystallized ribbons can be aged at 700° C. for up to 1 hour without any significant deterioration in mechanical properties.

A further type of preferred metallic glasses which can be converted by heat treatment in accordance with the method of this invention into devitrified crystalline alloys having high tensile strength and high thermal stability are cobalt based alloys having the formula (in atom percent)

$$Co_{30-80}Cr_{0-40}(Fe,Ni)_{0-20}(Mo,W)_{0-15}B_{5-12} \quad (D)$$

wherein the sum of Cr, Fe, Ni, Mo, and/or W cannot be less than 10 atom percent. Alloys of the above formula (D) containing more than about 25 atom percent of Cr have excellent oxidation resistance at elevated temperature. Exemplary alloys of the above stated formula (D) include: $Co_{50}Cr_{40}B_{10}$, $Co_{40}Ni_{10}Fe_{10}Cr_{30}B_{10}$, $Co_{55}Fe_{15}Ni_{10}W_6Mo_6B_8$, $Co_{65}Fe_{10}Ni_{10}Mo_7B_8$ and $Co_{50}Ni_{20}Fe_{22}B_8$.

Glassy bodies, e.g., ribbons of alloys of formula (D), above, when heated above their $T_c$'s to temperature within the range of about 800°-950° C. for 0.1 to 10 minutes are converted into ductile crystalline ribbons. Ultimate tensile strength values of these divitrified ribbons may be between about 250 and 350 kpsi depending on alloy composition and heat treatment cycle. Besides, these crystalline bodies have remarkably high thermal stability compared to that of the corresponding metallic glass bodies. Typically, the devitrified product can be aged at 700° C. for up to 1 hour without any significant deterioration in mechanical properties.

Another type yet of metallic glasses which can be converted by heat treatment in accordance with the method of this invention into devitrified crystalline alloys having high tensile strength and high thermal stability are nickel based compositions having the formula (in atom percent)

$$Ni_{30-80}Cr_{0-45}(Fe,Co)_{0-25}(Mo,W)_{0-10}B_{5-12} \quad (E)$$

wherein the combined content of Cr, Fe, Co, Mo and/or W cannot be less than 10 atom percent.

Alloys of the above formula (E) having chromium content above about 25 atom percent have excellent oxidation resistance at elevated temperatures. Examplary alloys of the above formula (E) include: $Ni_{45}Cr_{45}B_{10}$, $Ni_{57}Cr_{33}B_{10}$, $Ni_{65}Cr_{25}B_{10}$, and $Ni_{40}Co_{10}Fe_{10}Cr_{25}Mo_5B_{10}$.

Glassy bodies, e.g. ribbons of alloys of formula (E), above, when heated above their $T_c$'s to temperature within the range of about 800°-950° C. for 0.1 to 10 minutes are converted into ductile crystalline bodies, e.g. ribbons. Ultimate tensile strength values of these divitrified bodies may be between about 250 and 350 kpsi, depending on alloy composition and heat treatment cycle. Besides, these crystalline bodies have remarkably high thermal stability compared to that of the corresponding metallic glass bodies. Typically, the devitrified product can be aged at 700° C. for up to 1 hour without any significant deterioration in mechanical properties.

Another preferred type of metallic glasses which can be converted by heat treatment in accordance with the method of this invention into devitrified crystalline alloys having high tensile strength and high thermal stability are iron-based compositions having the formula:

$$Fe_{58-84}Cr_{5-15}Mo_{5-15}B_{5-10}(C,Si)_{1-5} \quad (F)$$

wherein the maximum combined metalloid content is 12 atom percent. Exemplary preferred alloy compositions of the above formula include $Fe_{69}Cr_{12}Mo_{10}B_8C_1$, $Fe_{60}Cr_{15}Mo_{15}B_7C_3$, $Fe_{65}Cr_{15}Mo_{10}B_6C_3Si_1$, $Fe_{70}C_{1.2}Mo_{10}B_6Si_4$, $Fe_{70}Cr_5Mo_{15}B_5Si_4$, $Fe_{70}Cr_{10}Mo_{10}B_7C_3$, $Fe_{70}Cr_{12}Mo_8B_6C_4$, $Fe_{75}Cr_{10}Mo_5B_9Si_1$, $Fe_{65}Cr_{10}Mo_{15}B_7Si_3$ and $Fe_{55}Cr_{10}Mo_{15}B_7C_1Si_2$. Glassy bodies e.g. ribbons of alloys of formula (F) when heat-treated in accordance with the method of invention, say at temperatures within the range 800°-950° C. for 10 minutes to 3 hours are converted into ductile crystalline bodies e.g. ribbons. Hardness values of these devitrified bodies e.g. ribbons, may vary from 450 DPH to 1000 DPH depending on alloy composition and heat treatment cycle. (The diamond pyrimid hardness test employs a 136° diamond pyramid indenter and variable loads. The Diamond Pyramid Hardness number (DPH) is computed by dividing the load in kilograms by the surface area of the indentation in square millimeters.) Besides, these crystalline bodies have remarkably high thermal stability, as compared to that of the corresponding metallic glass bodies. Typically, the crystallized ribbons can be aged at 700° C. for up to 1 hour without any significant deterioration in mechanical properties.

Another preferred type of metallic glasses which can be converted by heat treatment in accordance with the method of this invention into devitrified crystalline alloys having high tensile strength and high thermal stability, and excellent oxidation resistance at elevated temperatures are iron and nickel based alloys containing at least 5 atom percent of aluminum having the formulas:

$$Fe_{30-85}Ni_{0-20}Cr_{0-20}(Al,Mo,W)_{5-25}B_{5-12}(P,C,Si)_{0-3} \quad (G)$$

$$Ni_{30-85}Fe_{0-20}Cr_{0-20}(Al,Mo,W)_{5-25}B_{5-12}(P,C,Si)_{0-3} \quad (H)$$

wherein the combined content of Al, Cr, Mo and/or W cannot be less than 10 atom percent; the combined content of molybdenum and tungsten cannot be more than 5 atom percent, and the maximum combined content of metalloid elements may not exceed 12 atom percent. Exemplary perferred alloy compositions of the above formula (G & H) include:

$Fe_{70}Cr_{15}Al_5B_{10}$, $Fe_{60}Cr_{20}Al_{10}B_{10}$, $Fe_{65}Cr_{15}Al_{10}B_{10}$, $Fe_{60}Cr_{15}Al_{10}Mo_5B_{10}$, $Fe_{60}Cr_{15}Al_{15}B_{10}$ and $Ni_{60}Cr_{15}Al_{20}B_{10}$.

Glassy bodies e.g. ribbons of alloys of formulas G and H, when heat-treated in accordance with the method of invention, say at temperatures within the range 800°-950° C. for 10 minutes to 3 hours, are converted into ductile crystalline bodies e.g. ribbons. Hardness values of these devitrified bodies e.g. ribbons, may vary from 450 to 1000 DPH depending on alloy composition and heat treatment cycle. Besides, these crystalline bodies hav remarkably high thermal stability as compared to that of the corresponding metallic glass bodies. Typically, the crystallized ribbons can be aged at 700° C. for up to 1 hour without any significant deterioration in mechanical properties.

Another type yet of metallic glasses which can be coverted by heat treatment in accordance with the method of this invention into devitrified crystalline alloys having high tensile strength and high thermal stability are nickel based compositions having the formula:

$$Ni_{48-75}Cr_{0-20}Mo_{10-30}B_{5-12} \quad (I)$$

wherein when molybdenum is larger than 20 atom percent, chromium must be equal or less than 15 atom percent. Alloys of the above formula have excellent mechanical properties at elevated temperatures. Exemplary alloys of the above category include: $Ni_{55}Cr_{1.5}Mo_{20}B_{10}$, $Ni_{65}Mo_{25}B_{10}$, $Ni_{60}Mo_{30}B_{10}$, $Ni_{62}Cr_{1.0}Mo_{20}B_8$, and $Ni_{57}Cr_{10}Mo_{25}B_8$.

Glassy bodies e.g. ribbons of alloys of formula (I) above, when heat-treated in accordance with the method of the invention, say at temperatures within 900°-1050° C. for 2 to 6 hours are converted into ductile crystalline bodies e.g. ribbons. Hardness of these devitrified bodies e.g. ribbons, may vary from 600 to 1000 DPN depending on alloy composition and heat treatment cycle. Besides, these crystalline bodies have remarkably high thermal stability as compared to that of the corresponding metallic glass bodies. Typically, the crystallized ribbons can be aged at 700° C. up to 1 hour without any significant deterioration in mechanical properties.

The devitrified alloys of the present invention are generally, though not necessarily, ductile. Ductility is the ability of a material to deform plastically without fracture. As is well known to those skilled in the art, ductility can be measured by elongation or reduction in area in an Erichsen test, or by other conventional means. Ductility of intrinsically brittle filaments or ribbons can be measured by simple bend test. For example, metallic glass ribbons can be bent to form a loop, and the diameter of the loop is gradually reduced, until the loop is fractured. The breaking diameter of the loop is a measure of ductility of the ribbons. The smaller the breaking diameter for a given ribbon thickness, the more ductile is the ribbon considered to be. According to this test, the most ductile material can be bent to 180°.

The alloy compositions of formula (A), above, in fully amorphous glassy ribbon form (containing 100% glassy phase) generally have good ductility. In the bend test, as described above, the breaking diameter of such metallic glass ribbons having thickness of from about 0.025 mm to 0.05 mm is about 10 t (where t is the ribbon thickness) or lower. When alloy compositions of formula (A), above, are quenched into ribbons at lower quench rates, i.e. $10^3$-$10^4$° C./sec., they may contain up to 50% or more of crystalline phases, and the resultant ribbons are more brittle than more rapidly quenched ribbons. When these glassy ribbons are heat treated at or slightly below crystallization temperatures $T_x$ for various lengths of time, the ribbons tend to crystallize partially or fully and appear to be much more brittle in the bend test when compared to virgin metallic glass ribbons not subjected to heat treatment. Typically, the heat treated ribbons fracture with a breaking diameter of more than about 100 t. Even on prolonged annealing up to several hundreds of hours at or near crystallization temperatures, the ribbons still remain rather brittle. These brittle ribbons exhibit low fracture strength when tested in tension, compared to the as quenched glassy ribbons.

When glassy ribbons, including those of alloys of formula (A), above, are heat treated above $T_c$ and below 0.6 $T_s$ for prolonged period of time up to several hundred hours, the ribbons become fully crystalline and very brittle and possess low fracture strength. The heat treated ribbon readily break when formed into a bend with a diameter of less than about 100 t.

Metallic glass ribbons containing either phosphorus, carbon or silicon as the primary or major metalloid element when crystallized are always very brittle and exhibit low fracture strength. Prolonged heat-treatment at any temperature between $T_x$ and $T_s$ does not render these ribbons ductile.

In contrast, ribbons of glassy alloys having the composition of formula (A), above, typically are converted into ductile high strength crystalline products when heat-treated at temperature of from about 0.6 to about 0.95 $T_s$ for a time period of from about 0.01 to about 100 hours, and sufficient to carry the alloy through the brittle stage to the ductile form. In the bend test, these devitrified glasses in ribbon form show ductility comparable to or better than that of the corresponding as quenched glassy ribbons. These crystallized ribbons can be bent without fracture to a loop of a diameter of less than 10 t. These devitrified glasses, in form other than ribbon form, have correspondingly good ductility. The alloys thus heat treated are transformed into fully ductile crystalline alloys having high tensile strength above about 180 Kpsi. The required heat treatment time varies from about 0.01 hour at the upper temperature limit and 100 hours at the lower temperature limit.

Preferred heat treatment to achieve highest tensile strength in the devitrified alloys of formula (A), above, involves heating the glassy alloys to a temperature of from about 0.7 to about 0.8 $T_s$ for a time of from about 1 to about 20 hours.

Above the crystallization temperature $T_x$, all glassy alloys spontaneously devitrify (crystallize) at an extremely rapid rate. Homogeneous nucleation of crystalline phases and their rapid growth at the expense of the parent glassy phase take place in a matter of a few seconds. Devitrification can also occur when a metallic glass body, e.g. a ribbon, is subjected to isothermal annealing at or slightly below $T_x$. However, at these temperatures even after prolonged periods of annealing, the resulting devitrified body consists of an extremly fine grain structure with average grain size between 500 and 1000 Å which consists of an aggregate of equilibrium phases and some complex metastable phases. Such microstructure generally results in brittleness and low fracture strength. Devitrified ribbons so produced, when subjected to the above described bend test usually have a breaking diameter of more than 100 t , and have a fracture strength lower than 100 Kpsi. Similar microstructures and properties are obtained when annealing of the glassy alloy bodies of the above-stated formula (A) is carried out for insufficient (short) time at temperature between $T_x$ and $T_s$. Below about 0.6 $T_s$, even annealing for indefinitely long periods of time does not improve strength and ductility of the devitrified body. At temperatures above about 0.6 $T_s$, the metastable phases gradually begin to disappear with increasing annealing time to form equilibrium crystalline phases, accompanied by grain coarsening, resulting in an increase in tensile strength and ductility. Improvement in strength and ductility occurs more rapidly with increasingly higher annealing temperature above about 0.6 $T_s$. At temperatures between 0.6 $T_s$ and 0.95 $T_s$, ductility continues to increase with increasing annealing time. Within the temperature range of 0.6 $T_s$ to 0.95 $T_s$, tensile strength of the devitrified metallic glass body also tends to increase with increasing annealing temperature to reach a peak value, usually of more than about 180 Kpsi, and then decreases. The structure of the devitrified alloys at the peak tensile strength values consist of 100% equilibrium phases with a matrix of ultrafine grains (0.2 to 0.3 micron) of Fe, Ni, Co metals/solid solutions dispersed uniformly with 0.1 to 0.2 micron sized alloy boride particles.

Most preferred heat treatment to obtain highest tensile strength value involves heating the glassy alloys of formula (A), above, to temperature within the range of from about 0.7 $T_s$ to about 0.8 $T_s$ for a time period of about 0.5 to about 10 hours.

Employment of annealing temperatures outside of the above ranges, leads to undesirable results. At temperatures below about 0.6 $T_s$, the transformation kinetics are extremely sluggish and even after indefinitely long anealing time beyond 100 hours, the devitrified alloys tend to remain brittle and weak. From a practical standpoint, the heat treatment process is inefficient at temperatures below about 0.6 $T_s$. Moreover, if thermomechanical processing (i.e. hot extrusion, hot rolling, hot pressing, etc.) of the above glassy alloys is attempted below 0.6 $T_s$ to consolidate them into fully dense bulk-shaped devitrified parts, complete sintering will not be achieved and a fully dense compact cannot be obtained. At temperatures above about 0.95 $T_s$, the heat treatment time which would result in the desired microstructure is impracticably short, usually less than 10 seconds or so, and a ductile, devitrified alloy body cannot be obtained, especially under conditions of thermomechanical consolidation of ribbons, flakes or powders into bulk form, as to be described, infra.

The devitrified alloy bodies of the present invention are generally made from their glassy state in the form of powder, flake or ribbon. Methods for the preparation of glassy metal alloy powders, for example, are disclosed in my commonly assigned copending applications Ser. Nos. 23,411, 23,412, 23,413 filed Mar. 23, 1979. The preparation of glassy alloys in strip, wire and powder is, for example, disclosed in U.S. Pat. No. 3,856,553 issued Dec. 24, 1974 to Chen and Polk.

It is possible to consolidate the metallic glass alloys of formula (A), above, in form such as ribbon, wire, filaments, flake, powder by suitable metallurgical techniques into fully dense structural products having up to 100% crystalline phases and the above-described desirable microstructure. Powder, as used herein, includes fine powder with particle size under 100 microns, coarse powder with particle size between 100 microns and 1000 microns, as well as flake with particle size between 1000 microns and 5000 microns. The consolidation process is carried out under the same conditions of temperature and time as those required for devitrification of these alloys, as above described, under simultaneous application of heat and pressure, desirably isostatic pressure, at temperature of between about 0.6 and 0.95 $T_s$, for length of time sufficient to effect simultaneous devitrification and consolidation. Pressures suitable to effect consolidation are in the order of at least about 5000 psi, usually at least about 15,000 psi, higher pressures leading to products of higher density. Because of the very fine microstructure, these consolidated structural products made from glassy metal alloys have very good mechanical properties suitable for producing many engineering parts. Whereas the fine glassy metal powder is preferably initially cold pressed followed by sintering and densification by hot isostatic pressing, the larger size powder with a particle size of between about 100 mesh and 325 mesh is preferably directly hot isostatically compacted in a suitable mold. After simultaneous devitrification and compaction, as above described, the consolidated product can be machined to final desired dimensions. This process is suitable for fabrication of large engineering tools of simple geometry. The finished product can be further heat-treated, as desired, depending on the particular alloy used in the application at hand.

In one particular embodiment, the process of consolidation involves winding a metallic glass ribbon which can be devitrified into the two-phase precipitation hardened ultrafine crystalline state, as above described, such as ribbon having composition of formula (A), above, into a roll, enclosing the roll into a container, evacuating and sealing the container to prevent contact of the metallic glass ribbon with the ambient air, followed by sintering of the container roll at elevated temperature within the above indicated ranges, desirably under isostatic pressure of at least about 5000 psi, to obtain a fully dense metal body, e.g. a ring core consisting essentially of up to 100% crystalline phases.

In another specific embodiment discs are punched out of a strip of metallic glass, the discs are arranged into cylindrical shape by stacking in a cylindrical can of suitable diameter and material. The can containing the stacked discs is evacuated and hermetically sealed. The sealed can is heated to a suitable temperature for a sufficient time and is then hot extruded through a suitably dimensioned circular die to compact the discs into a fully dense rod consisting essentially of up to 100% crystalline phases.

In general, it is preferred to consolidate powders or flakes. Powders of metallic glass of composition of formula (A), above, contained in evacuated cans can be hot rolled into strips; hot extruded into rods; hot forged or hot swaged to any desired shape; and hot isostatically pressed to form discs, rings or blocks and the like. Powders can be compacted into strips having sufficient green strength which can be in-line sintered and hot rolled to fully dense crystalline strips.

The divitrified products obtained by heat treatment of metallic glass in accordance with the invention process are almost as strong and hard as the metallic glass starting material from which they are prepared. In addition, they have much better thermal stability than the corresponding glassy metal. For example, the $Fe_{51}Ni_{10}Co_5Cr_{10}Mo_6B_{18}$ product divitrified in accordance with the invention process, having the desired microstructure, retained its original ductility and hardness when heated to 600° C. for one hour.

EXAMPLES 1-39

Alloys were prepared from constituent elements of high purity (better than 99.9%). Charges of 30 g each were melted by induction heater in a quartz crucible under vacuum of $10^{-3}$ Torr. The molten alloy was held at 150° to 200° C. above the liquidus temperature for 10 min. and allowed to become completely homogenized before it was slowly cooled to solid state at room temperature. The alloy was fractured and examined for complete homogeneity.

The alloy was subsequently spincast against a chill surface provided by the inner surface of a rapidly rotating quench cylinder in the following manner.

About 10 g portions of the alloys were remelted and heated to 150° C. above the liquidus temperature under vacuum of $10^{-3}$ Torr in a quartz crucible having an orifice of 0.010 inch diameter in the bottom. The quench cylinder used in the present work was made of heat treated beryllium-copper alloy. The beryllium-copper alloy consisted of 0.4 to 0.7 weight percent beryllium and 2.4 to 2.7 weight percent cobalt, with copper as balance. The inner surface of the cylinder had a diameter of 30 cm, and the cylinder was rotated to provide a chill surface speed of 4000 ft/min. The quench cylinder and the crucible were contained in a vacuum chamber evacuated to $10^{-3}$ Torr.

The melt was spun as a molten jet by applying argon pressure of 5 psi over the melt. The molten jet impinged vertically onto the internal surface (the chill surface) of the rotating cylinder. The chill-cast ribbon was maintained in good contact with the chill surface by the centrifugal force acting on the ribbon. The ribbon was blown off the chill surface by a blast of nitrogen gas at 30 psi, two-thirds circumferential length away from the point of jet impingement. During the casting operation with the argon pressure applied over the melt and the blasting of nitrogen, the vacuum chamber was maintained under a dynamic vacuum of 20 Torr. The chill surface was polished with 320 grit emery paper and cleaned and dried with acetone prior to the start of the casting operation. The as-cast ribbons were found to have smooth edges and surfaces. The ribbons had the following dimensions: 0.001 to 0.012 inch thickness and 0.015 to 0.020 inch width. The chill cast ribbons were checked for glassiness by X-ray diffraction method.

A number of iron, nickel and cobalt base fully glassy ribbons containing from about 5 to 12 atom percent boron of composition within the scope of formula (A), above, were subsequently devitrified above their crystallization temperatures. The ribbons were heat treated under vacuum of $10^{-2}$ Torr at temperature of between 850° and 950° C. for periods of from about 10 minutes to 1 hour. The above heat-treatment temperatures corresponded to 0.7 to 0.8 of the solidus temperature of the alloys under present investigation. The heat-treated ribbons were found, by X-ray diffraction analysis, to consist of 100% crystalline phases. The heat-treated ribbons were found to be ductile to 180° bending, which corresponds to a radius of zero in the bending test. The hardness values of the devitrified ribbons ranged between 670 and 750 kg/mm$^2$. Hardness was measured by the diamond pyramid technique using a Vickers-type indenter, consisting of a diamond in the form of a square-base pyramid with an included angle of 136° between opposite faces. Loads of 100 grams were applied.

The microstructures of devitrified ribbons were examined by optical metallographic techniques. Optical metallography revealed extremely fine-grained, homogeneous microstructure of the devitrified ribbons. Table 1 lists the composition of the glassy alloy, heat treatment conditions, phases present in the heat-treated ribbons, and ductility, hardness and grain size of the heat-treated ribbons.

Ultimate tensile strength of some of the heat-treated ribbons was measured on an Instron machine using ribbon with unpolished edges. The results of tensile tests are given in Tables 2, 3 and 4. Optical metallographic pictures showing fine-grained microstructure of crystalline alloys devitrified from glassy phase are depicted in FIGS. 1, 2, 3 and 4 of the drawings.

Figure 5:
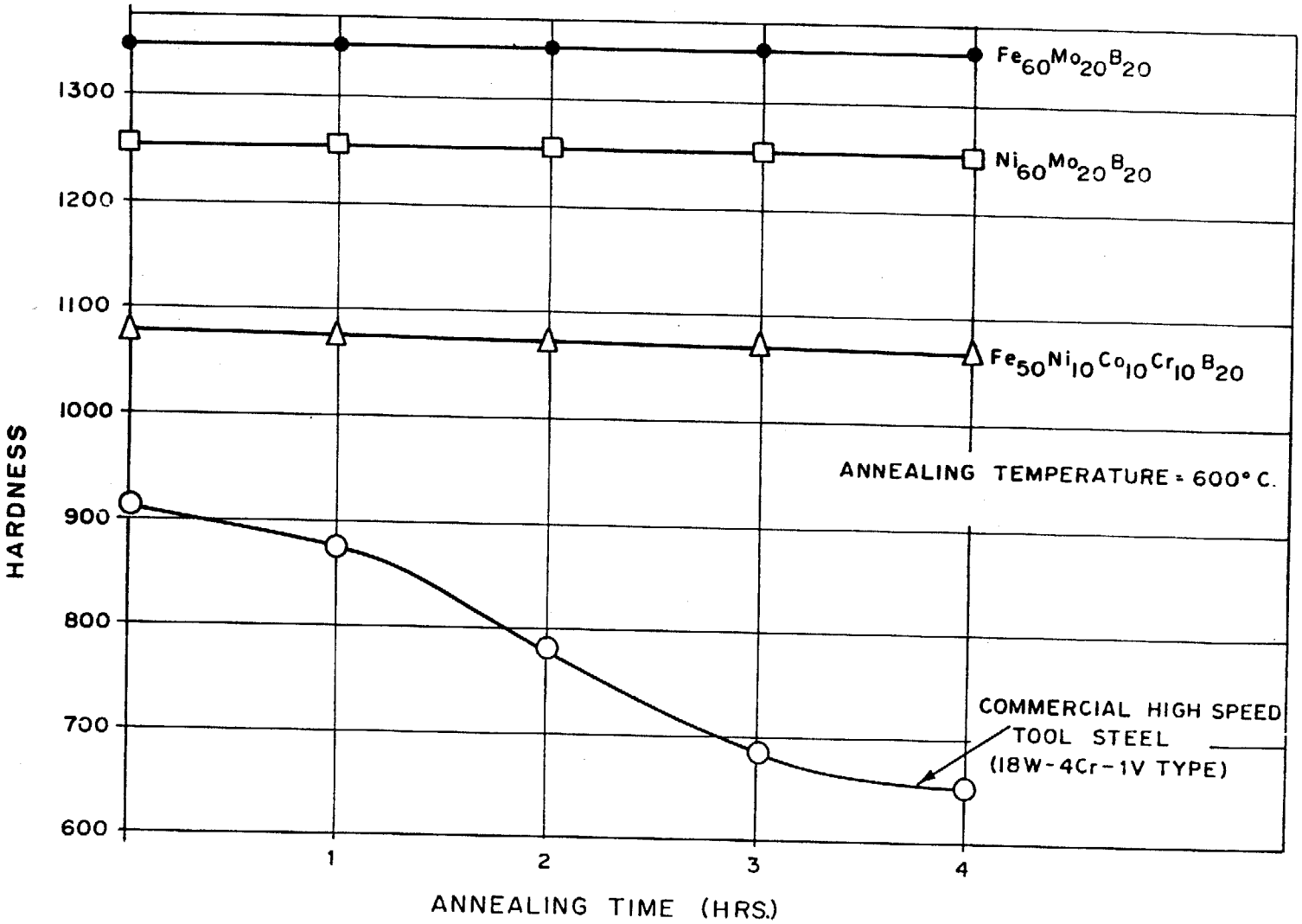
FIG. 5 is a schematic diagram showing the hardness versus annealing time at 600° C. for various alloys consolidated while hot from glassy phase.

FIG. 5 shows the breaking diameter of a loop of crystalline strip of $Fe_{40}Cr_{30}Ni_{10}Co_{10}B_{10}$ alloy as a function of annealing time at temperatures of 900° C., 950° C., and 1000° C. Initially for short time of annealing (i.e. less than 5 minutes) the strip remained brittle and exhibited correspondingly larger breaking diameters. With increasing annealing time, ductility of the strip was improved until it became fully ductile to 180° bending. The higher the temperature, the shorter the annealing time required to render the heat treated strip fully ductile to 180° bending.

Figure 6:
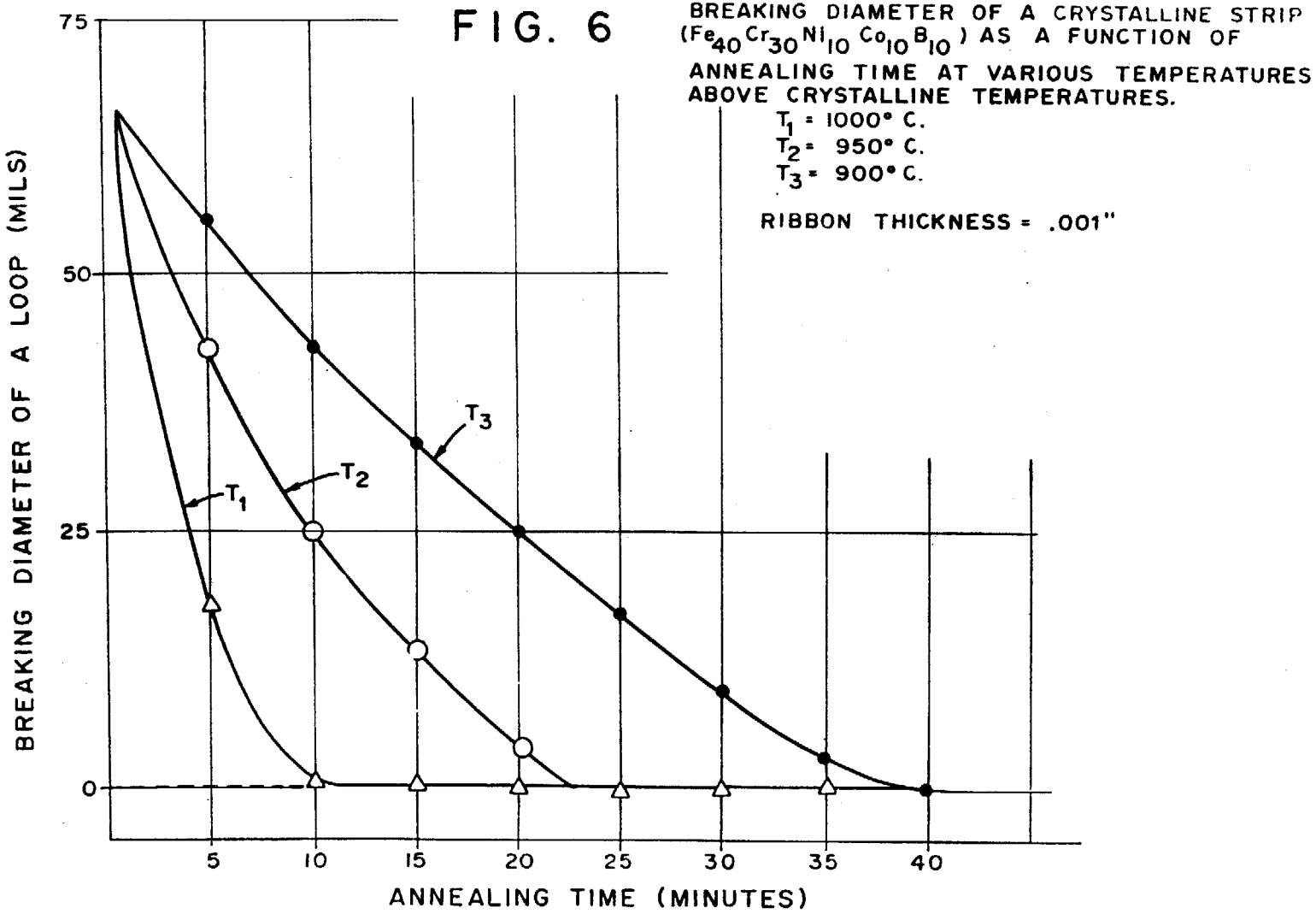
FIG. 6 is a schematic diagram showing the breaking diameter in loop test of a crystalline strip $Fe_{40}Cr_{30}Ni_{10}Co_{10}B_{10}$ as a function of annealing time at various temperatures.

The devitrified ribbons having alloy compositions of the present invention possess remarkable thermal stability at elevated temperatures. FIGS. 5 and 6 show hardness versus annealing time of $Ni_{40}Co_{10}Fe_{10}Cr_{25}Mo_5B_{10}$, $Fe_{40}Cr_{30}Ni_{10}Co_{10}B_{10}$ alloys crystallized at 950° C. and 900° C., followed by isothermal annealing at 700° C. No change in hardness was observed on aging up to 200 hours at 700° C.

TABLE 1

| Example | Compositions (at. pct.) | Heat Treatment | Phases Present After Heat Treatment | Ductile to 180° C. Bending | Hardness kg/mm$^2$ | Grain Size (micron) |
|---|---|---|---|---|---|---|
| 1 | $Fe_{50}Cr_{25}Ni_{10}Mo_5B_{10}$ | 900° C., ½ hr. | 100% Crystalline | yes | 750 | 0.2–0.3 |
| 2 | $Fe_{40}Ni_{10}Co_{10}Cr_{30}B_{10}$ | 900° C., ½ hr. | 100% Crystalline | yes | 700 | " |
| 3 | $Fe_{39}Cr_{25}Ni_{15}Co_{10}Mo_3W_2B_6$ | 850° C., 1 hr. | 100% Crystalline | yes | 720 | " |
| 4 | $Fe_{45}Co_{20}Ni_{15}Mo_{12}B_8$ | 900° C., ½ hr. | 100% Crystalline | yes | 700 | " |
| 5 | $Fe_{35}Cr_{25}Ni_{15}Co_{10}Mo_3W_2B_{10}$ | 900° C., 10 min. | 100% Crystalline | yes | 750 | " |
| 6 | $Fe_{45}Cr_{25}Ni_{10}W_5Mo_5B_{10}$ | 950° C., 1 hr. | 100% Crystalline | yes | 780 | " |
| 7 | $Fe_{56}Cr_{15}Ni_{15}Mo_4B_{10}$ | 900° C., ½ hr. | 100% Crystalline | yes | 700 | " |
| 8 | $Fe_{56}Cr_{25}Ni_7Mo_2B_{10}$ | 900° C., ½ hr. | 100% Crystalline | yes | 680 | " |
| 9 | $Fe_{56}Cr_{23}Ni_8Mo_3B_{10}$ | 900° C., ½ hr. | 100% Crystalline | yes | 700 | " |
| 10 | $Fe_{59}Cr_{18}Ni_{10}Mo_5B_8$ | 950° C., ½ hr. | 100% Crystalline | yes | 675 | " |
| 11 | $Fe_{58}Cr_{18}Ni_{10}Mo_4B_{10}$ | 950° C., ½ hr. | 100% Crystalline | yes | 670 | " |
| 12 | $Fe_{57}Cr_{10}Ni_{15}Mo_{12}B_6$ | 950° C., ½ hr. | 100% Crystalline | yes | 710 | " |
| 13 | $Fe_{57}Ni_{10}Cr_{10}Mo_6Co_5B_{12}$ | 860° C., 10 min. | 100% Crystalline | yes | 925 | " |
| 14 | $Ni_{40}Co_{10}Fe_{10}Cr_{25}Mo_5B_{10}$ | 900° C., ½ hr. | 100% Crystalline | yes | 700 | " |
| 15 | $Ni_{39}Cr_{25}Fe_{15}Co_{10}Mo_3W_2B_6$ | 900° C., ½ hr. | 100% Crystalline | yes | 700 | " |
| 16 | $Ni_{57}Co_{15}Fe_{10}Mo_{12}B_6$ | 900° C., ½ hr. | 100% Crystalline | yes | 725 | " |
| 17 | $Ni_{45}Co_{20}Fe_{15}W_6MO_6B_8$ | 900° C., ½ hr. | 100% Crystalline | yes | 730 | " |
| 18 | $Ni_{45}Co_{20}Fe_{15}Mo_{12}B_8$ | 900° C., ½ hr. | 100% Crystalline | yes | 725 | " |
| 19 | $Ni_{44}Co_{10}Fe_{12}Cr_{18}W_5Mo_5B_6$ | 900° C., ½ hr. | 100% Crystalline | yes | 720 | " |
| 20 | $Ni_{40}Cr_{25}Fe_{10}Mo_{10}Co_{10}B_5$ | 900° C., ½ hr. | 100% Crystalline | yes | 680 | " |
| 21 | $Ni_{39}Cr_{25}Fe_{15}Co_{10}Mo_3W_2B_6$ | 900° C., ½ hr. | 100% Crystalline | yes | 696 | " |
| 22 | $Co_{40}Ni_{10}Fe_{10}Cr_{30}B_{10}$ | 900° C., ½ hr. | 100% Crystalline | yes | 690 | " |

TABLE 1-continued

| Example | Compositions (at. pct.) | Heat Treatment | Phases Present After Heat Treatment | Ductile to 180° C. Bending | Hardness kg/mm² | Grain Size (micron) |
|---|---|---|---|---|---|---|
| 23 | $Co_{45}Cr_{20}Fe_{15}Ni_{10}B_{10}$ | 900° C., ¼ hr. | 100% Crystalline | yes | 720 | " |
| 24 | $Co_{60}Cr_{15}Fe_{10}Ni_{5}B_{10}$ | 900° C., ¼ hr. | 100% Crystalline | yes | 710 | " |
| 25 | $Co_{50}Cr_{20}Fe_{10}Ni_{10}B_{10}$ | 900° C., ¼ hr. | 100% Crystalline | yes | 695 | " |
| 26 | $Co_{55}Cr_{25}Fe_{5}Ni_{5}B_{10}$ | 900° C., ¼ hr. | 100% Crystalline | yes | 705 | " |
| 27 | $Co_{55}Fe_{15}Ni_{10}W_{6}Mo_{6}B_{8}$ | 900° C., ¼ hr. | 100% Crystalline | yes | 715 | " |
| 28 | $Co_{57}Ni_{10}Fe_{15}Mo_{12}B_{6}$ | 900° C., ¼ hr. | 100% Crystalline | yes | 720 | " |
| 29 | $Co_{50}Cr_{15}Mo_{5}Fe_{10}Ni_{10}B_{10}$ | 900° C., ¼ hr. | 100% Crystalline | yes | 705 | " |

TABLE 2

Tensile Properties of Exemplary Crystalline Iron Base Alloys Devitrified from Glassy Phase

| Example | Alloy Composition (at. Pct.) | Heat Treatment | Tensile Strength of Heat-treated ribbon (Kpsi) |
|---|---|---|---|
| 30 | $Fe_{39}Cr_{25}Ni_{15}Co_{10}Mo_{3}W_{2}B_{6}$ | 850° C., 1 hr. | 205 |
| 31 | $Fe_{57}Co_{10}Ni_{15}Mo_{12}B_{6}$ | 950° C., ½ hr. | 260 |
| 32 | $Fe_{35}Cr_{25}Ni_{15}Co_{10}Mo_{3}W_{2}B_{10}$ | 900° C., 10 min. | 325 |

TABLE 3

Tensile Properties of Exemplary Crystalline Nickel Base Alloys Devitrified from Glassy Phase

| Example | Alloy Composition (at. Pct.) | Heat Treatment | Tensile Strength of Heat-treated ribbon (Kpsi) |
|---|---|---|---|
| 33 | $Ni_{44}Co_{10}Fe_{12}Cr_{18}W_{5}Mo_{5}B_{6}$ | 900° C., ¼ hr. | 294 |
| 34 | $Ni_{40}Co_{10}Fe_{10}Cr_{25}Mo_{5}B_{10}$ | 900° C., ¼ hr. | 286 |
| 35 | $Ni_{45}Co_{20}Fe_{15}Mo_{12}B_{8}$ | 900° C., ¼ hr. | 315 |
| 36 | $Ni_{57}Fe_{10}Co_{15}Mo_{12}B_{6}$ | 900° C., ¼ hr. | 255 |

TABLE 4

Tensile Properties of Exemplary Crystalline Cobalt Base Alloys Devitrified from Glassy Phase

| Example | Alloy Composition (at. Pct.) | Heat Treatment | Tensile Strength of Heat-treated ribbon (Kpsi) |
|---|---|---|---|
| 37 | $Co_{40}Ni_{10}Fe_{10}Cr_{30}B_{10}$ | 900° C., ¼ hr. | 330 |
| 38 | $Co_{55}Ni_{10}Fe_{15}W_{6}Mo_{6}B_{8}$ | 900° C., ¼ hr. | 287 |
| 39 | $Co_{45}Ni_{20}Fe_{15}W_{12}B_{8}$ | 900° C., ¼ hr. | 260 |

EXAMPLES 40-66

A number of iron base alloys were spin cast against a chill surface provided by the outer surface of a rapidly rotating quench cylinder in the following manner.

About 450 g portions of the alloys were remelted and heated to 150° C. above the liquidus temperature under vacuum of $10^{-3}$ torr in a quartz crucible having an orifice of 0.040 inch diameter in the bottom. The quench cylinder used in the present work was made of heat treated beryllium copper alloy. The beryllium copper alloy consisted of 0.4 to 0.7 weight percent beryllium and 2.4 to 2.7 weight percent cobalt with copper as balance.

The outer surface of the cylinder had a diameter of 30 cm and the cylinder was rotated to provide a chill surface speed of 5000 ft/min. The quench cylinder and the crucible were contained in a vacuum chamber evacuated to $10^{-3}$ torr.

The melt was spun as a molten jet by applying argon pressure of 5 psi over the melt. The molten jet impinged vertically onto the outside surface (the chill surface) of the rotating cylinder. The chill surface was polished with 320 grit emery paper and cleaned and dried with acetone prior to the start of the casting operation. The as-cast ribbons were found to have smooth edges and surfaces. The ribbons had the following dimensions: 0.0015 to 0.0025 inch thickness and 0.015 to 0.020 inch width. The chill cast ribbons were checked for glassiness by x-ray diffraction method. The ribbons were found to be not fully glassy containing crystalline phases from 10 to 50 pct. The ribbons were found to be brittle by bend test.

The partially glassy ribbons containing from about 5 to 12 atom percent boron of composition within the scope of formula (A), above, were subsequently devitrified above their crystallization temperatures. The ribbons were heat treated under vacuum of $10^{-2}$ torr at 950° C. up to 3 hours. The above heat treatment temperature corresponded to 0.7 to 0.075 of the solidus temperature of the alloys under present investigation. The heat-treated ribbons were found by x-ray diffraction analysis to consist of 100% crystalline phases. The heat-treated ribbons were found to be ductile to 180° C. bending, which corresponds to a radius of zero in the bending test. The hardness values of the devitrified ribbons ranged between 500 to 750 kg/mm². Hardness was measured by the diamond pyramid technique using a Vickers-type indenter, consisting of a diamond in the form of a square-base pyramid with an included angle of 136° between opposite faces. Loads of 100 grams were applied.

Table 5, below, lists the composition of the glassy alloys, bend ductility of the ribbons in as-quenched conditions, heat treatment conditions, phases present in the heat-treated ribbons, ductility and hardness of the heat treated ribbons.

TABLE 5

| Example | Composition (at.pct.) | Results of Heat Treatment of Metallic Glass Ribbons above Crystallization Temperatures: Phases present in as quenched ribbon | Ductility of as quenched ribbon (average breaking dia. mils) | Heat Treatment | Phases Present after heat treatment | Hardness (kg/mm$^2$) after heat treatment | Ductiliy of heat-treated ribbon (average breaking dia, mils) |
|---|---|---|---|---|---|---|---|
| 40 | $Fe_{76}Cr_{12}W_2B_{10}$ | 80% glassy + 20% crystalline | 96 | 950° C., 3 hrs. | 100% crystalline | 560 | 2.3 |
| 41 | $Fe_{71}Cr_{12}Ni_3W_2Mo_1B_{10}C_1$ | 85% glassy + 15% crystalline | 130 | 950° C., 3 hrs. | 100% crystalline | 726 | 2.1 |
| 42 | $Fe_{72}Cr_{12}Ni_4W_2B_{10}$ | 90% glassy + 10% crystalline | 98 | 950° C., 3 hrs. | 100% crystalline | 554 | 2.1 |
| 43 | $Fe_{74}Cr_9Mo_6B_{11}$ | 75% glassy + 25% crystalline | 176 | 950° C., 3 hrs. | 100% crystalline | 483 | 2.1 |
| 44 | $Fe_{72}Cr_{13}Ni_2Mo_1W_{1.5}B_{10.5}$ | 80% glassy + 20% crystalline | 109 | 950° C., 3 hrs. | 100% crystalline | 501 | 2.3 |
| 45 | $Fe_{72}Cr_{14}Ni_2Co_2B_{10}$ | 80% glassy + 20% crystalline | 115 | 950° C., 3 hrs. | 100% crystalline | 596 | 2.1 |
| 46 | $Fe_{73}Cr_{15}W_2B_{10}$ | 75% glassy + 15% crystalline | 180 | 950° C., 3 hrs. | 100% crystalline | 525 | 2.1 |
| 47 | $Fe_{71.5}Cr_5Ni_{12}W_{1.5}B_{10}$ | 90% glassy + 10% crystalline | 115 | 950° C., 3 hrs. | 100% crystalline | 525 | 2.3 |
| 48 | $Fe_{80}Cr_4Ni_4W_2B_{10}$ | 70% glassy + 30% crystalline | 163 | 950° C., 3 hrs. | 100% crystalline | 496 | 2.2 |
| 49 | $Fe_{71}Cr_{12}Ni_3Mo_3W_1B_{10}$ | 80% glassy + 20% crystalline | 183 | 950° C., 3 hrs. | 100% crystalline | 560 | 2.3 |
| 50 | $Fe_{68}Cr_{12}Ni_6Mo_2W_2B_{10}$ | 75% glassy + 25% crystalline | 170 | 950° C., 3 hrs. | 100% crystalline | 618 | 2.2 |
| 51 | $Fe_{68}Cr_{13}Ni_6W_3B_{10}$ | 80% glassy + 20% crystalline | 155 | 950° C., 3 hrs. | 100% crystalline | 596 | 2.4 |
| 52 | $Fe_{75}Cr_{10}Ni_1Mo_3W_1B_{10}$ | 80% glassy + 20% crystalline | 114 | 950° C., 3 hrs. | 100% crystalline | 514 | 2.4 |
| 53 | $Fe_{73}Cr_{10}Ni_3Mo_4B_{10}$ | 65% glassy + 35% crystalline | 129 | 950° C., 3 hrs. | 100% crystalline | 518 | 2.4 |
| 54 | $Fe_{77}Cr_{8.5}Ni_1Mo_2W_{1.5}B_{10}$ | 80% glassy + 20% crystalline | 112 | 950° C., 3 hrs. | 100% crystalline | 535 | 2.3 |
| 55 | $Fe_{74}Cr_9Ni_2W_5B_{10}$ | 70% glassy + 30% crystalline | 86 | 950° C., 3 hrs. | 100% crystalline | 695 | 2.3 |
| 56 | $Fe_{72}Cr_{10}Ni_5Mo_3W_1B_9$ | 80% glassy + 20% crystalline | 151 | 950° C., 3 hrs. | 100% crystalline | 527 | 2.2 |
| 57 | $Fe_{70}Cr_{10}Ni_6Mo_4B_{10}$ | 70% glassy + 30% crystalline | 110 | 950° C., 3 hrs. | 100% crystalline | 508 | 2.2 |
| 58 | $Fe_{62}Cr_{18}Ni_8Mo_2B_{10}$ | 80% glassy + 20% crystalline | 128 | 950° C., 3 hrs. | 100% crystalline | 520 | 2.2 |
| 59 | $Fe_{63}Cr_{22}Ni_3Mo_2B_{10}$ | 65% glassy + 35% crystalline | 133 | 950° C., 3 hrs. | 100% crystalline | 535 | 2.2 |
| 60 | $Fe_{79}Cr_7Mo_3W_1B_{10}$ | 90% glassy + 10% crystalline | 129 | 950° C., 3 hrs. | 100% crystalline | 540 | 2.1 |
| 61 | $Fe_{66}Cr_{15}Ni_5W_3Mo_2B_9$ | 80% glassy + 20% crystalline | 157 | 950° C., 3 hrs. | 100% crystalline | 560 | 2.1 |
| 62 | $Fe_{74}Cr_{10}Ni_4W_2B_{10}$ | 70% glassy + 30% crystalline | 154 | 950° C., 3 hrs. | 100% crystalline | 528 | 2.1 |
| 63 | $Fe_{67}Cr_{10}Ni_{10}Mo_3B_{10}$ | 85% glassy + 15% crystalline | 121 | 950° C., 3 hrs. | 100% crystalline | 619 | 2.2 |
| 64 | $Fe_{62}Cr_{15}Ni_{10}W_2Mo_1B_{10}$ | 70% glassy + 30% crystalline | 72 | 950° C., 3 hrs. | 100% crystalline | 628 | 2.2 |
| 65 | $Fe_{69}Cr_{16}Ni_2W_1Mo_2B_{10}$ | 90% glassy + 10% crystalline | 109 | 950° C., 3 hrs. | 100% crystalline | 580 | 2.4 |
| 66 | $Fe_{66}Cr_{18}Ni_3Mo_2W_1B_{10}$ | 80% glassy + 20% crystalline | 125 | 950° C., 3 hrs. | 100% crystalline | 527 | 2.4 |

EXAMPLE 67

This example illustrates production of crystalline, cylinder, disc, rod, wire, sheet and strip by thermomechanical processing of thin metallic glass ribbons.

Metallic glass ribbons having the composition $Fe_{58}Ni_{10}Co_{10}Cr_{10}B_{12}$ and thickness of 0.002" are tightly wound into rolls. The rolls are stacked in a mild steel cylindrical or rectangular can. The empty space inside the can is filled and manually packed with powders of $Fe_{58}Ni_{10}Co_{10}Cr_{10}B_{12}$ glassy alloy having particle size of less than about 60 microns. The cans are evacuated to a pressure of $10^{-3}$ Torr, and purged three times with argon and is then closed by welding under vacuum. The metallic glass ribbons and powders in the sealed can are then consolidated by hot isostatic pressing for 1 hour at temperature between 750° and 850° C. under pressure of 15,000–25,000 psi to produce fully dense block of the devitrified alloy. It has a hardness of between 700 and 800 kg/mm$^2$, and is fully crystalline. It has a microstructure consisting of a uniform dispersion of fine submicron particles of complex boride phase in the matrix phase of iron, nickel, cobalt and chromium solid solution.

The sealed can may alternatively be heat-treated at temperature of 850°–950° C. for up to two hours and extruded in single or multiple steps with extrusion ratios between 10:1 and 15:1 to produce fully dense consolidated crystalline materials having hardness of between 1000 and 1100 kg/mm$^2$.

Further, the sealed can may also be hot rolled at temperature of between 850° and 950° C. in 10% reduction passes to obtain flat stock ranging from plate to thin strip. The hot-rolled flat stocks are fully dense and crystalline, and have hardness values between 600 and 700 kg/mm$^2$.

EXAMPLE 68

Examples are given herein of production of crystalline cylinder, disc, rod, wire, flat stock such as plate, sheet and strip having superior mechanical properties by thermomechanical processing metallic glass powder (fine, coarse or flaky). Metallic glass powder having the composition $Fe_{65}Mo_{10}Cr_5Ni_5Co_3B_{12}$ and particle size ranging between 25 and 100 microns is hand packed in mild steel cylindrical or rectangular cans. In each case, the can is evacuated to $10^{-3}$ Torr and then sealed by welding. The powders are then consolidated by hot isostatic pressing (HIP), hot extrusion, hot-rolling or combination of these methods to produce various structural stocks such as cylinder, disc, rod, wire, plate, sheet or strip.

Hot isostatic pressing is carried out at temperatures of between 750° and 800° C. for 1 hour under pressure of 15,000 to 25,000 psi. The resultant cylindrical compacts are fully dense and crystalline. These compacts are given a final heat-treatment at 850° C. for ½ hour to optimize the microstructure.

For hot extrusion the sealed evacuated can containing the powders is heated to 850°-950° C. for 2 hours and immediately extruded through a die at reduction ratios as high as 10:1 and 20:1.

For hot rolling, the evacuated can containing the powders is heated to temperature of between 850° C. and 950° C. and passed through rollers at 10 percent reduction passes. The resulting flat stock is then heat-treated at 850° C. from 15 to 30 minutes to optimize the microstructure. The devitrified consolidated structural stocks fabricated from metallic glass powders by the various hot consolidation techniques as described above have hardness values in the order of 600 to 800 kg/mm$^2$.

EXAMPLE 69

This example illustrates production of metallic strip devitrified from glassy metal powder.

Metallic glass powder having the composition $Fe_{58}Ni_{20}Cr_{10}B_{12}$ with particle size below about 30 microns is fed into the gap of a simple two high roll mill so that it is compacted into a coherent strip of sufficient green density. The mill rolls are arranged in the same horizontal plane for convenience of powder feeding. The green strip is bent 180° with a large radius of curvature to avoid cracking and, is pulled through an annealing furnace. The furnace has a 20" long horizontal heating zone maintained at a constant temperature of 750° C. The green strip travelling at 20" per minute through the heating zone becomes partially sintered. The sintered strip exits the furnace at 750° C. and is further roll compacted in a 10% reduction pass. The rolled strip is subsequently hot-rolled in 10% reduction passes between 700°-750° C.

After the last roll pass, the strip is heated for ½ hour at 850° C. by passing it through an annealing furnace followed by cooling by wrapping it 180° around a water cooled chill roll. The strip has a microstructure consisting of 45-50 volume fraction of alloy boride phase uniformly dispersed as submicron particles in the matrix phase. The devitrified strip has a hardness in the order of 950 to 1050 kg/mm$^2$.

EXAMPLE 70

This example illustrates fabrication of consolidated stock from thin (0.002") and flat metallic glass stock.

Circular or rectangular pieces are cut from or punched out of 0.002" thick metallic glass strip having the composition $Ni_{48}Cr_{10}Fe_{10}Mo_{10}Co_{10}B_{12}$. These pieces are stacked into closely fitting cylindrical or rectangular mild steel cans. The cans are evacuated to $10^{-3}$ Torr and sealed by welding. The metallic glass pieces in the cans are then consolidated hot isostatic pressing, hot extrusion, hot-rolling or combination of these methods to produce structural parts of various shapes.

The hot isostatic pressing is carried out at temperature of from 750° C. to 850° C. for 1 hour under pressure of 15,000 to 25,000 psi. The resultant compacts are fully dense and crystalline. These compacts are further annealed by heat treatment at 900° C. for one hour. The heat treatment results in optimization of the microstructure. The resultant compacts consist of 50 to 55 volume fraction of submicron particles uniformly dispersed in the matrix phase.

The sealed cans may also be extruded and/or hot rolled, and optionally annealed, as described in the previous examples.

The crystalline structural parts of various shapes fabricated from thin metallic glass stocks by these procedures as described above have high hardness values in the order of between 600 and 800 kg/mm$^2$.

EXAMPLES 71-75

These examples illustrate production of high strength devitrified crystalline rods by the method of hot extrusion of iron base metallic glass alloy powders. About 10 pounds of powders of each different glassy alloy with particle size under 100 mesh were packed in 3¼" O.D. mild steel cans and sealed off under vacuum. The cans were heated at 950° C. for 2½ hours and extruded into 1" dia. rods. The extruded rods were tested for tensile strength, and the results are given in Table 6, below.

TABLE 6

Room temperature tensile properties of crystalline iron base alloys hot extruded from glassy powders.

| Example | Composition (atom percent) | Ultimate Tensile Strength (PSI) |
|---|---|---|
| 71 | $Fe_{70}Cr_{18}Mo_2B_{10}$ | 218,000 |
| 72 | $Fe_{70}Cr_{13}Ni_6Mo_1B_9Si_1$ | 228,700 |
| 73 | $Fe_{63.5}Cr_{14.5}Ni_{10}Mo_2B_{10}$ | 222,500 |
| 74 | $Fe_{62.5}Cr_{16}Mo_{11.5}B_{10}$ | 228,000 |
| 75 | $Fe_{63.5}Cr_{15}Mo_{11.5}B_8Si_2$ | 208,600 |

EXAMPLE 76

A metallic glass alloy having the composition $Fe_{63}Cr_{22}Ni_3Mo_2B_8C_2$ was made into powder with particle size under 80 mesh. The powder was hot extruded in an evacuated can at 1050° C. into a fully dense devitrified body. The corrosion behavior of the devitrified, consolidated bodies was studied and compared with that of Type 304 and Type 316 stainless steel. Results indicate that the corrosion rate of the devitrified alloy is about one tenth of that of 304 and 316 stainless steels in sulfuric acid at room temperature.

EXAMPLE 77

This example illustrates excellent Charpy 'V' notch impact strength (Metals Handbook) at elevated temperatures of an exemplary devitrified crystalline iron base alloy of the present invention, hot extruded from glassy metal powder.

TABLE 7

| Alloy Composition | Room Temp. Hardness, Rockwell C | Charpy 'V' Notch Impact Strength (Ft.-lbs.) 500° F. | 800° F. | 1000° F. |
|---|---|---|---|---|
| $Fe_{69}Cr_{17}Mo_4B_{10}$ | 39 | 37 | 24 | 35 |

EXAMPLE 78

This example illustrates production of devitrified crystalline rod by thermomechanical processing of thin metallic glass ribbons. About 10 pounds of ½" to ⅝" wide metallic glass ribbons having composition $Fe_{63}Cr_{12}Ni_{10}Mo_3B_{12}$ were tightlly wound in 3¼" dia. rolls. The rolls were stacked in a mild steel can and sealed off under vacuum. The can was heated at 950° C. for 2½ hours and hot extruded into a fully dense 1¼" diameter rod. The extruded rod was found to have ultimate tensile strength of 200,000 psi, % elongation of 5.1 and % reduction in area of 7.1 at room temperature.

EXAMPLE 79

This example illustrates production of devitrified crystalline rod by thermomechanical processing of powders of a nickel base metallic glass alloy having the composition $Ni_{48}Cr_{10}Fe_{20}Co_5Mo_5B_{12}$ (at. pct.).

Approximately 10 pounds of metallic glass powder of the above stated composition powder with particle size under 100 mesh (U.S.) were packed in a 3¼" O.D. mild steel can be sealed off under vacuum. The can containing the powder was heated at 900° C. for two hours, and hot extruded into a fully dense crystalline 1" dia. rod. The extuded rod was tested for tensile strength and hardness at room temperature as well as elevated temperatures. The results are given in table 8, below. The devitrified alloy showed excellent hot hardness and hot strength characteristics up to 1100° F.

TABLE 8

Tensile strength and hardness of a crystalline nickel base alloy rod, $Ni_{48}Fe_{20}Cr_{10}Co_5Mo_5B_{12}$ (at. pct.) hot extruded from glassy powders.

| Temperature | Ultimate Tensile Strength (KSI) | Hardness (Rockwell C) |
|---|---|---|
| Room Temperature | 216 | 50.5 |
| 600° F. | 199 | 46.8 |
| 900° F. | | 44.8 |
| 1000° F. | 184 | |
| 1100° F. | 172 | |

EXAMPLE 80

This example illustrates excellent oxidation resistance in air at elevated temperatures of an exemplary devitrified crystalline iron base alloy $Fe_{69}Cr_{17}Mo_4B_{10}$ (atom percent) prepared by hot extrusion of glassy powder. After exposure in air at 1300° F. for 300 hours, no scale formation was noticed and the oxidation rate was found to be very low at 0.002 mg/cm²/hour.

EXAMPLE 81

A metallic glass alloy having the composition $Fe_{70}Cr_{18}Mo_2B_{10}$ (atome pct) was made into powder with particle size under 80 mesh (U.S.). The powder was hot extruded after heating at 950° C. for 2 hours in an evacuated sealed can, to obtain a fully dense, devitrified rod. The devitrified crystalline alloy was found to have excellent high temperature stability of mechanical properties up to 1000° F. as illustrated in Table 9 below.

TABLE 9

Tensile properties of a devitrified crystalline iron base alloy $Fe_{70}Cr_{18}Mo_2B_{10}$ hot extruded from glassy powders.

| Temperature | Ultimate Tensile Strength (PSI) |
|---|---|
| 200° F. | 218,000 |
| 600° F. | 220,000 |
| 800° F. | 220,000 |
| 1000° F. | 185,000 |

EXAMPLE 82

A metallic glass alloy having the composition $Fe_{70}Cr_{18}Mo_2B_9Si_1$ (atomic percent) was made into powder (−80 mesh U.S.). The powder was put in a mild steel can, evacuated and sealed off and subsequently hot extruded after heating at 950° C. for 2 hours with an extrusion ratio of 9:1. The extruded rod was found to be fully dense and consisting of a fully devitrified fine grained microstructure. The hardness of a sample for the extruded rod was tested from room temperature to 1200° F. The devitrified material was found to have excellent resistance to softening at elevated temperatures up to 1200° F. (See Table 10 below).

TABLE 10

Hot hardness values of a devitrified crystalline iron base alloy $Fe_{70}Cr_{18}Mo_2B_9Si_1$ (atomic percent) hot extruded from glassy powder.

| Temperature | Hardness (Rockwell C) |
|---|---|
| Room Temp. | 44 |
| 600° F. | 43 |
| 800° F. | 43 |
| 1000° F. | 43 |
| 1200° F. | 42.5 |

EXAMPLES 83-93

A number of iron base fully glassy ribbons within the scope of the present invention were devitrified above their crystallization temperatures at 950° C. for 3 hours. The heat treated ribbons were found by x-ray diffraction analysis to consist of 100% crystalline phases. The heat treated ribbons were found to be ductile to 180° bending, which corresponds to a radius of zero in the bending test. The hardness values are summarized in Table 11, below, ranged between 450 to 950 kg/mm².

TABLE 11

Results of heat treatment (950° C. for 3 hours) of iron based glassy ribbons.

| Example | Composition (at pct.) | Phases Present After Heat Treatment | Ductile to Bending | Hardness kg/mm² |
|---|---|---|---|---|
| 83 | $Fe_{63}Cr_{22}Ni_3Mo_2B_8C_2$ | 100% crystalline | Yes | 545 |
| 84 | $Fe_{63}Cr_{12}Ni_{10}Mo_3B_{12}$ | 100% crystalline | " | 525 |
| 85 | $Fe_{69}Cr_{17}Mo_4B_{10}$ | 100% | " | 505 |

TABLE 11-continued

Results of heat treatment (950° C. for 3 hours) of iron based glassy ribbons.

| Example | Composition (at pct.) | Phases Present After Heat Treatment | Ductile to Bending | Hardness kg/mm² |
|---|---|---|---|---|
| 86 | $Fe_{70}Cr_{10}Ni_5Mo_5B_{10}$ | crystalline 100% crystalline | " | 599 |
| 87 | $Fe_{70}Cr_{12}Ni_5Mo_3B_{10}$ | 100% crystalline | " | 560 |
| 88 | $Fe_{64}Cr_{10}Mo_{16}B_{10}$ | 100% crystalline | " | 464 |
| 89 | $Fe_{68}Cr_{10}Mo_{12}B_{10}$ | 100% crystalline | " | 530 |
| 90 | $Fe_{70}Cr_{10}Ni_5Mo_5B_8Si_2$ | 100% crystalline | " | 580 |
| 91 | $Fe_{67}Cr_{10}Mo_{13}B_{10}$ | 100% crystalline | " | 525 |
| 92 | $Fe_{67}Cr_{15}Mo_8B_9C_1$ | 100% crystalline | " | 620 |
| 93 | $Fe_{60}Cr_{15}Mo_{15}B_7C_3$ | 100% crystalline | " | 544 |

Metallic glasses (amorphous metals) are conveniently prepared by rapid quenching from the melt of certain glass-forming alloys. This requires quench rates in the order of $10^5$ to $10^6$° C. per second, or higher. Such quench rates are obtained by depositing molten metal in a thin layer onto a heat extracting member, such as a block of copper. Known methods for doing this include splat quenching, hammer-and-anvil quenching, as well as the melt-spin procedures. However, in all of these procedures, the quenched glassy metal product must have at least one small dimension, usually less than 0.1 mm thick. Glassy metals obtained by melt-quench procedure, therefore, are limited to powders, thin wires, and thin filaments such as strip or sheet. Many metallic glasses have outstanding properties such as high hardness, high strength, corrosion resistance, and/or magnetic properties. However, the thinness of the bodies in which metallic glasses are obtained by melt-quench procedures has in the past limited their use. Also, on heating to even moderately low temperatures, metallic glasses will devitrify to form crystalline materials, and to date no outstanding uses for such crystalline material obtained by devitrification of metallic glasses have been developed, principally because of the thinness of the devitrified material.

The present invention therefore further provides a method for making three-dimensional articles having a thickness of at least 0.2 mm, measured in the shortest dimension, from metallic glass bodies by compacting metallic glass bodies having a thickness of less than about 0.2 mm, measured in the shortest dimension, and subjecting the metallic glass bodies to temperature of between about 600° and 2000° C., but below the solidus temperature of the alloy of which metallic glass body consists, to obtain consolidation into a solid article.

The metallic glass body may, for example, be a metallic glass powder, a splat or a filament such as wire, sheet or strip.

In one embodiment the metallic glass body is metallic glass powder which is compacted into a perform of sufficient grain strength for handling, and the preform is then sintered for time sufficient to consolidate it into a solid article.

Usually, the metallic glass bodies, such as metallic glass powder, are simultaneously subjected to heating and compression to effect devitrification of the metallic glass into a crystalline structure is consolidation into a solid body. Desirably, this is accomplished by subjecting the metallic glass simultaneously to compression and to heat at temperature of between about 0.6 and 0.95 of the solidus temperature of the metallic glass in °C.

The above-described consolidation procedures are applicable to metallic glass bodies of any composition, without limitation, and include, for example, those disclosed in the following patents, the disclosures of which are hereby incorporated by reference: U.S. Pat. Nos. 3,856,513 to Chen et al.; 3,981,722 to Ray et al.; 3,986,867 to Masumoto et al.; 3,989,517 to Tanner et al.; 4,116,682 to Polk et al. and others.

Preferred alloys are based on members of the group consisting of iron, cobalt, nickel, molybdenum and tungsten.

Preferred alloys include those having the composition:

$$(Fe,Co,Ni)_uM_xB_y(P,C,Si)_z$$

wherein

M is one or more of chromium, molybdenum, tungsten, vanadium, niobium, titanium, tantalum, aluminum, tin, germanium, antimony, beryllium, zirconium, manganese and copper, u, x, y and z represent atom percent of (Fe,Co,Ni, M, B, (P,C,Si), respectively, and have the following values u=45 to 90 x=5 to 30 y=12 to 25 z=0 to 25-y.

Another type of preferred alloys has the composition:

$$(Fe,Co,Ni)_uM_xB_y(P,C,Si)_z$$

wherein

M is one or more of chromium, molybdenum, tungsten, vanadium, niobium, titanium, tantalum, aluminum, tin, germanium, antimony, beryllium, zirconium, manganese and copper, u, x, y and z represent atom percent of (Fe,Co,Ni, M, B, (P,C,Si), respectively, and have the following values u=45 to 90 x=5 to 35 y=5 to 12 z=1 to 25 with the proviso that the combined amount of boron, carbon, silicon and phosphorus exceeds 13 atom percent.

A further type of preferred alloys has the composition:

$$(Fe,Co,Ni,Cr,V)_uM_x(B,P,C,Si)_z$$

wherein

M is one or more of molybdenum and tungsten u, x, z represent atom percent of (Fe,Co,Ni,Cr,V), M, (B,P,C,Si) respectively and have the following values u=20–45 x=32–70 z=5–25

The following examples further illustrate the combined devitrification-consolidation aspect for metallic glasses broadly.

EXAMPLE 94

Metallic glass powder of the composition $Mo_{60}Fe_{20}B_{20}$ was consolidated by hot pressing into a dense compact. The hardness of the resulting compact was 1750 kg/mm$^2$, which compares closely with the hardness of expensive fine grain WC-Co with 3% cobalt of about 1,800 kg/mm$^2$. X-ray analysis showed that the compact consisted of up to 100% crystalline phases. The microstructure was found to consist of hard alloy boride particles dispersed in a matrix consisting of a fine grain molybdenum solid solution phase.

EXAMPLE 95

Metallic glass alloys of the composition $Fe_{65}Cr_{15}B_{20}$, $Fe_{65}Mo_{15}B_{20}$, $Fe_{86}B_{14}$, $Fe_{60}Co_5Ni_5Mo_{10}B_{20}$, $Co_{70}Mo_{10}B_{20}$, and $Ni_{60}Cr_{20}B_{20}$ were melt-spun in the form of ribbons of 0.050 inches width and 0.0015 inches thickness. These glassy ribbons had glass transition temperatures in the range between 380° C. to 490° C. The ribbons were annealed under high purity argon atmosphere at temperatures ranging from 100° to 150° C. below the respective glass transition temperature for ½ to 2 hours until the ribbons were found to be embrittled. The heat treatment condition for each alloy was chosen such that they were embrittled yet they remained fully glassy, as determined by X-ray analysis. The embrittled ribbons were dry ball milled in an alumina jar using alumin balls under high purity argon atomsphere. The milling time varied from about ½ to 3 hours. The resulting powders were screened and size fractioned. About 10 grams of powder of each alloy having particle size within the range of from 25 microns to 125 microns were unidirectionally hot pressed into cylindrical compacts of 4000 psi for ½ hour under vacuum of $10^{-2}$ Torr. At temperature of 800° to 900° C. The hardness of the hot pressed compacts varied from 962 to 1250 kg/mm$^2$. X-ray analysis showed that the hot pressed compacts contained up to 100% crystalline phases. All the compacts were found to have similar microstructure consisting of an ultra fine grain structure with grain size of 0.3 to 0.5 microns. These compacts can be fabricated into cutting tools other wear-resistant parts.

EXAMPLE 96

Metallic Glass ribbons of the composition $Fe_{70}Cr_5Mo_5B_{20}$ were embrittled by heat treatment below the glass transition temperature, and the embrittled ribbons were commingled into powder of particle size below 125 microns. The powder was pressed under vacuum at 800° C. for ½ hour at 4,000 psi into ½" diameter by ¼" thick discs. The microstructure of the hot pressed discs consisted of fine boride particles with average size of about 0.5 micron dispersed in a metal matrix. The microhardness of the discs was found to be 1,175 kg/mm$^2$, which compares favorably to the microhardness of 18-4-1 type high speed tool steel 990 kg/mm$^2$.

EXAMPLE 97

Metallic glass products such as fragmented or comminuted ribbon, and splat cast powder or flake were hot pressed at 700°-900° C. under vacuum of $10^{-2}$ Torr for ½ hour at 4000 psi into dense cylindrical compacts essentially consisting of 100% crystalline phases. The compositions and hardness values of compacts fabricated using this technique are summarized in the Table below. Typically, iron boron base metallic glass alloys containing 15 to 30 atomic percent chromium and/or molybdenum can be hot consolidated into dense compacts with hardness ranging between 1100 to 1350 kg/mm$^2$. Cobalt base metallic glass alloys containing boron as the major metalloid yielded dense compacts with hardness ranging between about 1060 to 1400 kg/mm$^2$. Hardness values of nickel base alloys ranged between about 920 and 1350 kg/mm$^2$.

Compacts prepared from metallic glass powders having the composition $Ni_{60}Cr_{20}B_{20}$, $Fe_{65}Cr_{15}$, $B_{20}$, $Ni_{50}Mo_{30}B_{20}$ and $Co_{50}Mo_{30}B_{20}$ were prepared as described above and were kept immersed in a solution of 5 St % NaCl in water at room temperature for 720 hours. After that exposure, they exhibited no traces of corrosion.

EXAMPLE 98

Metallic glass ribbons having the composition $Fe_{50}Ni_{10}Co_{10}Cr_{10}B_{20}$ and thickness of 0.002" are tightly tape-wound into rolls. The rolls are stacked upon one another and then placed in mild steel cylindrical or rectangular cans. The empty space inside the can is filled and manually packed with powders of $Fe_{50}Ni_{10}Co_{10}Cr_{10}B_{20}$ glassy alloy having particle size less than 60 microns. The cans are evacuated to a pressure of $10^{-3}$ Torr and purged three times with argon before final closure under vacuum. The metallic glass ribbons and powders in the sealed can are consolidated by hot isostatic pressing (HIP), hot extrusion, hotrolling or combinations of these methods into cylinder, disc, rod, wire sheet and strip of various dimensions. Hot isostatic pressing is carried out for 1 hour between 750° and 850° C. at 15,000-25,000 psi to produce fully dense cylinders and discs. These HIP processed cylinders and discs have hardness values ranging between 1000 and 1100 kg/mm$^2$. They consist of crystalline phases up to 100%. The microstructure of these crystalline materials consist of uniform dispersion of fine submicron particles of complex boride phase in the matrix phase of iron, nickel, cobalt and chromium solid solution.

The hot extrusion process is carried out at 750°-850° C. with rolls of Metglas ribbon in sealed cylindrical cans or cylindrical HIP cans. The extrusion is carried out in single or multiple steps with extrusion ratios between 10:1 and 15:1 producing fully dense crystalline materials in various forms ranging from rod to wire. These extruded products have hardness values between 1000 and 1100 kg/mm$^2$.

A rectangular HIP can is hot rolled between 750° and 850° C. in 10% reduction passes. The resulting flat stocks ranges from plate to thin strip. The hot-rolled flat stocks are fully dense containing crystalline phases up to 100 percent. These materials have hardness values between 1000 and 1100 kg/mm$^2$.

EXAMPLE 99

Metallic glass powders having the composition $Fe_{60}Mo_{10}Cr_5Ni_5Co_3B_{17}$ and particle size ranging between 25 to 100 microns are hand packed in mild steel cylindrical or rectangular cans. In each case, the can is evacuated to $10^{-3}$ Torr and then sealed by welding. The powders are then consolidated by hot isostatic pressing (HIP), hot extrusion, hot rolling or combination of these methods to produce various structural stocks such as cylinder, disc, rod, wire, plate, sheet or strip.

Hot isostatic pressing is carried out at temperature of between 750° and 800° C. for ½ hr at pressure of 15,000 to 25,000 psi. The resultant cylindrical or thick flat stocks are fully dense with crystalline phases up to 100 percent. These compacts are given a final heat-treatment at 850° C. for ½ hour to obtain the optimized microstructure consisting of 45–50 volume fraction of submicron particles uniformly dispersed in the matrix phase.

The cylindrical HIP cans as well as sealed cylindrical cans containing powders are heated to 850° C. for ½ hour and immediately extruded to rod/wire forms with extrusion ratios between 10:1 and 20:1.

The rectangular HIP cans as well as the rectangular sealed cans containing the powders are hot rolled between 750° and 850° C. in 10 percent reduction passes. The resulting flat stocks ranging between plate to thin strip are heat-treated at 850° C. from 15 to 30 minutes to obtain the optimized microstructure. The crystalline structural stocks fabricated from metallic glass powders by various hot consolidation techniques as described above have hardness values between 1050 and 1150 kg/mm$^2$.

EXAMPLE 100

Metallic glass powders having the composition $Fe_{50}Ni_{20}Cr_{10}B_{20}$ with particle size below 30 microns are fed into the roll gap of a simple two high mill where it is compacted into a coherent strip of sufficient green density. The mill rolls are arranged in the same horizontal plane for convenience of powder feeding. The green strip is bent 180° with a large radius of curvature to avoid cracking and pulled through an annealing furnace. The furnace has a 20" long horizontal heating zone maintained at a constant temperature of 750° C. The green strip travelling at 20" per minute through the heating zone becomes partially sintered. The sintered strip exits the furnace at 750° C. and further roll compacted in 10% reduction pass. The rolled strip is further hot rolled in 10% reduction passes between 700°–750° C. The resultant metallic strip is fully dense consisting of crystalline phases up to 100 percent.

After the last roll pass, the strip is heated for ½ hour at 850° C. in a controlled travelling mode. Following annealing, the strip is cooled by wrapping it 180° around a water cooled chill roll and finally it is wound under tension in a spool. The strip has a microstructure consisting of 45–50 volume fraction of alloy boride phase uniformly dispersed as submicron particles in the matrix phase. The crystalline strip having the composition $Fe_{50}Ni_{20}Cr_{10}B_{20}$ prepared in accordance with the present invention has hardness values between 950 and 1050 kg/mm$^2$.

EXAMPLE 101

The circular or rectangular pieces are punched out of 0.002" thick metallic glass strips having the composition $Ni_{40}Cr_{10}Fe_{10}Mo_{10}Co_{10}B_{20}$. The punchings are stacked in cylindrical or rectangular mild steel cans with close fittings. In each case, the can is evacuated to $10^{-3}$ Torr and then sealed by welding. The stacked metallic glass pieces are then consolidated hot isostatic pressing (HIP), hot extrusion, hot rolling or combination of these methods to produce structural parts of various shapes.

Hot isostatic pressing is carried out at temperature between 750° and 850° C. for ½ hour at 15,000 to 25,000 psi. The resultant cylindrical or thick flat HIP compacts are fully dense and contain crystalline phases up to 100 percent. These HIP compacts are further annealed at 900° C. for one hour. The heat treatment results in optimization of the microstructure of the compacts consisting of 50–55 volume fraction of submicron particles uniformly dispersed in the matrix phase.

The sealed cans containing the stacked pieces as well as the cylindrical hot isostatically pressed cans are heated to 900° C. for various lengths of time and immediately extruded to rod/wire forms with extrusion ratios between 10:1 and 20:1 in single or multiple steps. Total heating time at 900° C. ranges between ½ to 1 hour.

The rectangular hot isostatically pressed cans and the rectangular can containing the stacked pieces of the metallic glass alloy are hot rolled between 800° and 900° C. in 10% reduction passes. The resultant flat stocks ranging between plate to thin strip are heat treated at 900° C. from 15 to 30 minutes to obtain the optimized microstructure.

The crystalline structural parts of various shapes fabricated from thin metallic glass stocks by the procedures as described above have high hardness values ranging between 1100 and 1200 kg/mm$^2$.

TABLE 12

| Alloy Composition (at. pct.) | Metallic Glass Powder Prepared by | Particle Size Range Micron | Hot-Pressed in Vacuum $10^{-2}$ Torr for ½ hr. at Temperature °C. | Hardness of Hot Pressed Compacts at 100 gm Load kg/mm$^2$ | Microstructure of Hot Pressed Compacts Average Grain Size (micron) |
|---|---|---|---|---|---|
| $Mo_{60}Fe_{20}B_{20}$ | Comminution of Embrittle Ribbon | 75–125 | 1100° C. | 1750 | 0.3 to 0.5 |
| $Mo_{40}Fe_{40}B_{20}$ | Same as Above | " | 1000° C. | 1600 | " |
| $Fe_{50}Mo_{30}B_{20}$ | " | " | 900° C. | 1350 | " |
| $Fe_{65}Mo_{15}B_{20}$ | " | " | 850° C. | 1250 | " |
| $Fe_{65}Cr_{15}B_{20}$ | " | " | 800° C. | 1180 | " |
| $Fe_{60}Mo_{20}B_{20}$ | " | " | 850° C. | 1300 | " |
| $Fe_{60}Mo_{10}Cr_{10}B_{20}$ | " | " | 850° C. | 1300 | " |
| $Fe_{60}Cr_{20}B_{20}$ | " | " | 800° C. | 1220 | " |
| $Fe_{80}B_{20}$ | " | " | 800° C. | 1090 | " |
| $Fe_{75}Mo_5B_{20}$ | " | " | 800° C. | 1150 | " |
| $Fe_{70}Mo_{10}B_{20}$ | " | " | 800° C. | 1200 | " |
| $Fe_{70}Cr_{10}B_{20}$ | " | 75 to 125 | 800° C. | 1150 | " |
| $Fe_{70}Mo_5Cr_5B_{20}$ | " | " | 800° C. | 1175 | " |
| $Fe_{55}Mo_{25}B_{20}$ | " | " | 900° C. | 1400 | " |
| $Fe_{70}W_5Mo_5B_{20}$ | " | " | 850° C. | 1300 | " |
| $Fe_{70}W_{10}B_{20}$ | " | " | 900° C. | 1350 | " |
| $Fe_{65}W_5Cr_5Mo_5B_{20}$ | " | " | 900° C. | 1350 | " |
| $Fe_{65}Mo_{10}Co_5B_{20}$ | " | " | 800° C. | 1200 | " |
| $Fe_{60}Co_5Ni_5Mo_{10}B_{20}$ | " | " | 800° C. | 1150 | " |
| $Fe_{50}Ni_{20}Mo_{10}B_{20}$ | " | " | 800° C. | 1100 | " |

TABLE 12-continued

| Alloy Composition (at. pct.) | Metallic Glass Powder Prepared by | Particle Size Range Mesh | Hot-Pressed in Vacuum $10^{-2}$ Torr for ½ hr. at Temperature °C. | Hardness of Hot Pressed Compacts at 100 gm Load kg/mm² | Microstructure of Hot Pressed Compacts Average Grain Size (micron) |
|---|---|---|---|---|---|
| $Fe_{87}B_{13}$ | Comminution of Embrittle Ribbon | 75 to 125 micron | 850° C. | 950 | 0.3 to 0.5 |
| $Fe_{69}Co_{17}B_{14}$ | Same as Above | " | 850° C. | 960 | " |
| $Fe_{86}B_{14}$ | " | " | 850° C. | 962 | " |
| $Fe_{76}Co_{10}B_{14}$ | " | " | 850° C. | 965 | " |
| $Fe_{67}Ni_{20}B_{13}$ | " | " | 850° C. | 900 | " |
| $Fe_{50}Ni_{10}Co_{10}Cr_{10}B_{20}$ | " | " | 800° C. | 1080 | " |
| $Fe_{40}Ni_{20}Co_{10}Cr_{10}B_{20}$ | " | " | 800° C. | 1100 | " |
| $Fe_{60}Mo_{10}Cr_5Ni_5Co_3B_{17}$ | " | " | 800° C. | 1075 | " |
| $Fe_{45}Ni_{10}Co_7Mo_{10}Cr_8B_{20}$ | " | " | 800° C. | 1250 | " |
| $Fe_{50}Al_5Mo_{2.5}Cr_8Ni_{10.5}Co_5B_{19}$ | " | " | 800° C. | 1150 | " |
| $Fe_{52.5}Ni_{10}Cr_{10}V_2Co_5W_5Ta_{1.5}B_{16}$ | " | " | 850° C. | 1160 | " |
| $Fe_{40}Ni_{40}P_{14}B_6$ | Chill substrate Quenching of Atomized molten droplets | 150–225 micron | 700° C. | 850 | — |
| $Fe_{25}Ni_{25}Co_{20}Cr_{10}P_{16}B_4$ | Chill substrate Quenching of Atomized molten droplets | " | 700° C. | 900 | " |
| $Fe_{70}Cr_5Ni_5P_{15}B_5$ | Comminution of Embrittled Ribbon | 75 to 125 micron | 700° C. | 920 | " |
| $Fe_{60}Cr_{15}Ni_5P_{15}B_5$ | Comminution of Embrittled Ribbon | " | 750° C. | 935 | " |
| $Fe_{50}Ni_8Co_7Cr_{15}P_{20}$ | Comminution of Embrittled Ribbon | " | 750° C. | 920 | " |

| Alloy Composition (at. pct.) | Metallic Glass Powder Prepared by | Particle Size Range (micron) | Hot-Pressed in Vacuum $10^{-2}$ Torr for ½ hr. Temperature | Hardness of Hot Pressed Compacts at 100 gm Load kg/mm² |
|---|---|---|---|---|
| $Co_{70}Mo_{10}B_{20}$ | Comminution of Embrittled Ribbon | 75 to 125 micron | 800° C. | 1200 |
| $Co_{60}Mo_{20}B_{20}$ | Fragmentation of Brittle Ribbon | " | 850° C. | 1350 |
| $Co_{65}Mo_{15}B_{20}$ | Fragmentation of Brittle Ribbon | " | 800° C. | 1250 |
| $Co_{55}Mo_{25}B_{20}$ | Fragmentation of Brittle Ribbon | " | 850° C. | 1400 |
| $Co_{50}Cr_{15}Fe_{15}Mo_4B_{16}$ | Fragmentation of Brittle Ribbon | " | 800° C. | 1150 |
| $Co_{45}Fe_{17}Ni_{13}Cr_5Mo_3B_{17}$ | Chill substrate Quenching of Atomized molten droplets | 150 to 225 micron | 800° C. | 1120 |
| $Co_{44}Cr_6Fe_{18}Ni_{15}B_{17}$ | Comminution of Embrittled Ribbon | 75 to 125 micron | 800° C. | 1080 |
| $Co_{70}Fe_{10}B_{20}$ | Chill substrate Quenching of Atomized molten droplets | 150 to 225 micron | 800° C. | 1090 |
| $Co_{40}Ni_{20}Fe_{20}B_{20}$ | Chill substrate Quenching of Atomized molten droplets | | 800° C. | 1060 |
| $Co_{45}Ni_{20}Cr_{10}FE_5Mo_2B_{18}$ | | | 900° C. | 805 |
| $Co_{60}Fe_{20}B_{20}$ | | | 900° C. | 860 |
| $Ni_{45}Co_{20}Cr_{10}Fe_5Mo_4B_{16}$ | Chill-substrate even liquid atomized powder | 150–225 micron | 750° C. | 920 |
| $Ni_{44}Co_{24}Cr_{10}Fe_5B_{17}$ | Chill-substrate even liquid atomized powder | flake (.008") | 750° C. | 900 |
| $Ni_{40}Co_{25}Cr_9Mo_{11}B_{16}$ | Chill-substrate even liquid atomized powder | flake (.008") | 850° C. | 1060 |
| $Ni_{40}Fe_{10}Co_{15}Cr_{10}Mo_9B_{16}$ | Chill-substrate even liquid atomized powder | flake (.008") | 850° C. | 1040 |
| $Ni_{60}Cr_{20}B_{20}$ | comminutionof embrittled ribbons | 75–125 | 900° C. | 1150 |
| $Ni_{60}Mo_{10}Cr_{10}B_{20}$ | comminution of embrittled ribbons | " | 900° C. | 1220 |
| $Ni_{60}Mo_{20}B_{20}$ | fragmentation of ribbons | 150–225 | 900° C. | 1260 |
| $Ni_{50}Mo_{30}B_{20}$ | fragmentation | " | 900° C. | 1350 |

TABLE 12-continued

| | | | | |
|---|---|---|---|---|
| | of ribbons | | | |
| $Ni_{40}Co_{20}Mo_{20}N_{20}$ | fragmentation of ribbons | " | 900° C. | 1300 |
| $Ni_{40}Cr_{10}Fe_{10}Co_{10}Mo_{10}B_{20}$ | fragmentation of ribbons | " | 850° C. | 1200 |
| $Ni_{50}Fe_{18}Co_{15}B_{17}$ | — | — | 900° C. | 735 |

Furthermore, the present invention provides iron-based, boron and carbon-containing transition metal alloys, which contain at least two metal components, and which are composed of ultrafine grains of a primary solid solution phase randomly interspersed with particles of complex borides, wherein the complex boride particles are predominantly located at the junctions of at least three grains of the ultrafine grain solid solution phase, and wherein the ultrafine grains of the solid solution phase in turn are interspersed with carbide particles. These alloys are amenable to heat treatment to change their hardness and ductility, analogous to the manner in which hardness and ductility of steel may be changed by heat treatment.

In alloys of the present invention having the above-described morphology, the grains of the primary solid solution phase (which are in turn interspersed with carbide particles) as well as the complex boride particles can be, and desirably are, obtained in ultra-fine particle size. Desirably, these grains have an average largest diameter of less than about 3 microns, more desirably of less than about 1 micron, and the complex boride particles have average largest diameter of less than about 1 micron, more desirably of less than about 0.5 micron, as viewed on a microphotograph of an electron microscope. The average largest diameter of the ultra-fine grains of the primary solid solution phase, as well as that of the complex boride particles, are determined by measuring, on a microphotograph of an electron microscope, the diameter of the grains and particles, respectively, in the largest dimension and averaging the values thus determined.

Suitable alloys include those having the composition of the formula $$Fe_m(Co,Ni)_nCr_pM_qB_rC_s(P,Si)_t$$

wherein (a) M is one or more of molybdenum, tungsten, vanadium, niobium, titanium, tantalum, aluminum, tin, germanium, antimony, beryllium, zirconium, manganese and copper;

(b) m, n, p, q, r, s and t are in atomic percent and have the following values:

m=40–80
n=0–45
p=0–45
q=0–30
r=5–12
s=0.5–3
t=0–7.5 with the provisos that (1) the sum of n+p+q is at least 5; (2) when q is larger than 20, then p must be less than 20; and (3) the amount of each of vanadium, manganese, copper, tin, termanium, and antimony may not exceed 10 atom percent.

Exemplary preferred alloys include those having the composition $$Fe_{bal}Cr_{5-10}V_{1-3}W_{3-5}Mo_{3-7}B_{7-8}C_{2-2.75}Si_{0.5-1}$$

The above-described iron-based, boron and carbon-containing transition metal alloys having the above-described microstructure are obtained by devitrification of the corresponding glassy (amorphous) alloy, as described supra. They can be consolidated in the solid, three-dimensional bodies in above-described manner.

Modification of ductility and hardness properties of these alloys by heat treatment depends on the type and structure of the carbide particles which are precipitated within the primary grains of the primary solution phase or on cooling of the alloy, and the composition, morphology and structure may be modified through heat treatment (rapid quenching, tempering, annealing). Thus, while these boride and carbide containing alloys tend to be very hard and brittle when rapidly quenched, they tend to be relatively less hard and more ductile when slowly cooled from elevated temperature (e.g. from a temperature at which the carbide particles are dissolved in the primary solid solution phase). In that state these alloys are readily machineable into any desired form, e.g. cutting tools. Thereafter, the machined parts, e.g. cutting tools, are again heated and quenched to desired hardness to obtain hard cutting tools having excellent durability. During the heat treatment (e.g., tempering) the boride particles remain substantially unchanged, as regards their size and their location. Also, the ultrafine grains of the primary solid solution phase remain fine, because the presence of the boride particles at the juncture of at least three grains tends to block grain coarsening. The carbide particles, however, may be dissolved and/or precipitated on heating and cooling, respectively, and the manner in which they are precipitated determines their characteristics (composition, structure and location), and their characteristics in turn determine the properties of the alloy (e.g., strength, hardness, ductility).

Exemplary alloy compositions for these iron based, boron and carbon containing alloys include the following:

$Fe_{73}Cr_{10}Ni_2Mo_5B_8C_2$, $Fe_{74}Cr_{14}Mo_2B_8C_2$, $Fe_{69}Cr_{12}Ni_5W_2Mo_2B_{9.5}Co_{0.5}$, $Fe_{70}Cr_{12}W_4Mo_4B_9C_1$, $Fe_{70}Cr_{10}Mo_{10}B_8C_1Si_1$, $Fe_{60}Cr_{20}V_{0.5}W_{5.5}Mo_4B_8C_{1.5}S_{0.5}$, $Fe_{60}Cr_{10}W_2Mo_{18}B_8C_2$, $Fe_{60}Cr_{12}W_3Mo_{15}B_8C_2$, $Fe_{60}Cr_{10}W_3Mo_{17}B_8C_2$, $Fe_{65}Cr_{10}Mo_{15}B_8C_2$, $Fe_{60}Cr_{10}Mo_{20}B_8C_2$, $Fe_{60}Ni_{10}Cr_{10}Mo_{10}B_8C_2$, $Fe_{70}W_{20}B_8C_2$, $Fe_{50}Ni_{10}Cr_{10}Mo_{20}B_8C_2$, $Fe_{45}Ni_{15}Cr_{10}Mo_{20}B_8C_2$, $Fe_{55}Ni_5Cr_{10}Mo_{20}B_8C_1Si_1$, $Fe_{40}Cr_{30}W_{20}B_8C_2$, $Fe_{40}Cr_{20}Ni_{10}W_{20}B_8C_2$, $Fe_{50}Cr_{20}Mo_{20}B_8C_2$, $Fe_{55}Cr_{10}Ti_{15}Mo_{10}B_8C_2$, $Fe_{55}Cr_{10}Zr_{15}Mo_{10}B_8C_2$, $Fe_{65}Cr_{15}W_{10}B_8C_2$, $Fe_{70}Cr_{10}Mo_{10}B_8C_2$, $Fe_{50}Ni_5Cr_{10}Mo_{25}B_8C_2$, $Fe_{70}Mo_{20}B_8C_2$, $Fe_{70}Cr_5Mo_{15}B_8C_2$, $Fe_{75}W_{15}B_8C_2$, $Fe_{77}V_1Cr_5W_7B_9C_1$, $Fe_{70}Co_6V_2Cr_5W_7B_8C_2$, $Fe_{77}Cr_4V_2Mo_3W_4B_8C_2$, $Fe_{70}Cr_9V_3Mo_4W_4B_8C_2$, $Fe_{70}Cr_8V_2Mo_5W_5B_8C_2$, $Fe_{76.5}Cr_3V_1Mo_3W_6B_8C_2Si_{0.5}$, $Fe_{75}Cr_5Mo_{10}B_7C_2Si_1$, $Fe_{70}Cr_{15}W_5B_7C_2Si_1$, $Fe_{70}Cr_{14}Mo_5B_7C_3Si_1$, $Fe_{65}Cr_{15}Mo_{10}Ni_5B_9C_1$, $Fe_{54}Cr_{20}Mo_{10}Ni_5B_9C_2$, $Fe_{60}Cr_{12}Ni_{10}Mo_8B_8C_2$, $Fe_{52}Cr_{16}Ni_{10}Mo_{12}B_8C_2$, $Fe_{52}Cr_{16}Ni_{10}Mo_6W_6B_8C_2$, $Fe_{60}Cr_{10}Mo_{20}B_8C_2$, $Fe_{60}Cr_{10}W_{10}Mo_{10}B_8C_2$, $Fe_{60}Cr_{14}Mo_{16}B_8C_2$, $Fe_{59}V_{5.5}Cr_{15}Mo_{10}B_9C_{1.5}$, $Fe_{71.5}V_3W_6Cr_5Mo_5B_8C_{1.5}$, $Fe_{70.5}V_2Cr_{10}Mo_7B_9C_{1.5}$, $Fe_{66}Cr_{18}Ni_4W_2B_8C_2$, $Fe_{61}Ni_{10}Cr_{10}Mo_4W_5B_8C_2$, $Fe_{51}Ni_{10}Cr_{12}Mo_4W_6Co_7B_8C_2$, $Fe_{68}Cr_8W_3Ni_2V_1Mo_8B_8C_2$, $Fe_{70}Cr_{10}Ni_3Mo_7B_8C_1Si_1$, $Fe_{62}Cr_{12}Ni_{10}Mo_6B_8C_2$, $Fe_{74}Cr_{10}W_4Mo_3B_7C_2$, $Fe_{70}Cr_{15}V_1W_4B_8C_1Si_1$, $Fe_{70}Cr_{10}V_1Mo_4W_5B_8C_1Si_1$, $Fe_{70}Cr_{14}Mo_2W_4B_8C_2$, $Fe_{79}Cr_4W_7B_8C_2$, $Fe_{70}Cr_8V_1W_{11}B_8C_1Si_1$, $Fe_{69}Cr_{11}V_1Co_4W_5B_{7.5}C_{2.5}$, $Fe_{70}Cr_{12}V_2Mo_3W_3B_{8.5}C_{1.5}$, $Fe_{70}V_1Cr_{13}W_6B_8C_2$, $Fe_{72}Co_4V_1Cr_6W_7B_8C_2$, $Fe_{70}Cr_{12}V_2Mo_3W_3B_8C_2$, $Fe_{68}Cr_{10}V_1W_{11}B_8C_1Si_1$, $Fe_{69}Cr_{13}V_2Mo_3W_3B_8C_2$, $Fe_{78}Cr_5W_7B_8C_1Si_1$, $Fe_{70}Cr_5Ni_5Mo_{10}B_8C_2$, $Fe_{61}Cr_{10}Ni_3V_3Co_6Mo_4W_3B_7C_1Si_1$, $Fe_{61}Cr_{12}Ni_5V_3Nb_2Mo_7C_2B_8$, $Fe_{56.5}Cr_{10}Co_{10}Ni_3Nb_2Ti_{0.5}Mo_3W_5B_8C_2$, $Fe_{59}Cr_{10}V_3Mn_1Ni_5Nb_2W_3Mo_7B_7C_2Si_1$, $Fe_{50}Cr_{20}Ni_{10}W_{10}B_8C_2$, $Fe_{70}Cr_{10}Mo_8W_2B_8C_1Si_1$, $Fe_{70}Cr_8Mo_9W_3B_7C_2Si_1$, $Fe_{70}Co_8Mo_3W_6Cr_3B_7C_2Si_1$, $Fe_{75}Cr_6Mo_2W_6B_8C_2Si_1$, $Fe_{70}Cr_{11}Mo_2W_6B_8C_2Si_1$, $Fe_{70}Cr_{10}Mo_8W_2B_8C_2$, $Fe_{68}V_2Cr_{10}Mo_8W_2B_8C_2$, $Fe_{66}Co_2V_2Cr_{10}W_5Mo_5B_9C_1$, $Fe_{70}Co_3V_1Cr_{10}W_3Mo_2B_9C_2$, $Fe_{75}Cr_5Mo_{10}B_7C_2Si_1$, $Fe_{72}Cr_7Mo_8V_3B_8C_2$, $Fe_{72}Cr_8V_2W_1Mo_6B_8C_2Si_1$, $Fe_{70.5}Cr_{10}V_2W_3Mo_4B_8C_2Si_{0.5}$, $Fe_{71.5}Co_6V_2W_2Mo_3Cr_5B_8C_2Si_{0.5}$, $Fe_{71}Co_6V_2W_1Mo_5Cr_5B_7C_2Si_1$, $Fe_{68.5}Co_3V_1W_3Mo_4Cr_{10}B_{7.5}C_{2.5}Si_{0.5}$, $Fe_{78.5}V_2Mo_2W_2Cr_5B_{7.5}C_{2.5}Si_{0.5}$, $Fe_{70}V_2Mo_3W_3Cr_{12}B_{7.5}C_{2.5}$, $Fe_{64}Co_6V_1Mo_8W_7Cr_3B_{7.5}C_{2.5}Si_1$, $Fe_{71}V_2Mo_6W_2Cr_8B_8C_2Si_1$, $Fe_{76}Co_3V_1W_6Cr_4B_8C_2$, $Fe_{71}Mo_4V_2W_6Cr_6B_8C_3$, $Fe_{76}Cr_5Mo_1W_6B_9C_3$, $Fe_{68}Co_5Cr_8Mo_6W_2B_8C_{2.5}Si_{0.5}$.

EXAMPLE 102

An alloy containing both boron and carbon with the composition $Fe_{75}Cr_{10}Mo_5B_8C_2$ was prepared. Glass made of this composition was devitrified at 950° C. where borides precipitated and prevented grain growth, but the carbon was dissolved into an austenitic solid solution. Slow cooling then allowed carbide precipitation at lower temperatures and when the material reached room temperature it was ductile and relatively soft (hardness=450 kg/mm$^2$). When the material was quenched from 950° C. and there was insufficient time for carbide precipitation, the austenitic solid solution transformed into martensite. In this state, the material was ductile with a hardness of 950 kg/mm$^2$. Tempering (reheating to 600° C.) reduced this hardness to 750 kg/mm$^2$.

EXAMPLE 103

A powdered metal compact was made from glassy alloy of composition $Fe_{63}Cr_{22}Ni_3Mo_2B_8C_2$. This alloy had about ten times the resistance to sulfuric acid corrosion as Type 316 stainless steel. Some of the important parameters for 1N $H_2SO_4$ at 22° C. were:

| Material | Corrosion Rate (A/cm$^2$) | Passivation Potential (mV) | Passivated Corrosion Rate (A/cm$^2$) |
|---|---|---|---|
| 316 Stainless | 5.2 | −215 | 9.0 |
| STM-20 | 0.18 | −020 | 1.0 |

I claim:

1. Boron-containing transition metal alloys, based on one or more of iron, cobalt and nickel, containing at least two metal components, said alloys being composed of ultrafine grains of a primary solid solution phase randomly interspersed with particles of complex borides, wherein said complex boride particles are predominantly located at the junctions of at least three grains of said ultrafine grain solid solution phase.

2. The alloys of claim 1 in powder form.

3. The alloys of claim 1 in filament form.

4. Alloy bodies according to claim 1 having a thickness of at least 0.2 millimeter, measured in the shortest dimension.

5. Alloys according to claim 1 wherein said ultrafine grains of the primary solid solution phase have an average largest diameter of less than about 3 microns, and wherein said complex boride particles have an average largest diameter of less than about 1 micron, as viewed on a microphotograph of an electron microscope.

6. Alloys according to claim 1 wherein said ultrafine grains of the primary solid solution phase have an average diameter, measured in its longest dimension, of less than about 1 micron, and wherein said complex boride particles have average particle size, measured in its largest dimension, of less than about 0.5 micron, as viewed on a microphotograph of an electron microscope.

7. Alloys according to claim 6 in powder form.

8. Alloys according to claim 6 in filament form.

9. Alloy bodies according to claim 6 having a thickness of at least 0.2 millimeter, measured in the shortest dimension.

10. Alloys according to claim 1 having the composition $$R_uR_v'Cr_wM_xB_y(P,C,Si)_z$$

wherein

R is one of iron, cobalt or nickel;

R' is one or two or iron, cobalt or nickel other than R;

Cr, B, P, C and Si respectively represent chromium, boron, phosphorus, carbon and silicon;

M is one or more of molybdenum, tungsten, vanadium, niobium, titanium, tantalum, aluminum, tin, germanium, antimony, beryllium, zirconium, manganese and copper;

u, v, w, x, y and z represent atom percent of R, R', Cr, M, B and (P,C,Si), respectively, and have the following values:

u=30–85
v=0–30
w=0–45
x=0–30
y=5–12
z=0–7.5 with the provisos that (1) the sum of v+w+x is at least 5; (2) when x is larger than 20, then w must be less than 20; and (3) the amount of each of vanadium, manganese, copper, tin, germanium, antimony, beryllium, and magnesium may not exceed 10 atom percent.

11. Alloy compositions according to claim 11 wherein said ultrafine grains of the primary solid solution phase have an average diameter, measured in its longest dimension, of less than about 1 micron, and wherein said complex boride particles have average particle size, measured in its longest dimension, of less than about 0.5 micron, as viewed on a microphotograph of an electron microscope.

12. Alloys according to claim 12 containing from about 1 to about 15 atom percent of one or more of a refractory metal selected from the group consisting of Mo,W,Mb and Ta.

13. Alloys according to claim 12 in powder form.

14. Alloy bodies according to claim 12 having a thickness of at least 0.2 millimeter, measured in the shortest dimension.

15. Alloy compositions according to claim 12 having the formula $$R_{30-75}R'_{10-30}Cr_{0-30}M_{0-15}B_{5-12}(P,C,Si)_{0-2.5}$$

wherein

R is one of Fe, Co and Ni;

R' is one or more of Fe, Co and Ni other than R;

M is one or more of Mo, W, Nb and Ta;

with the provisos that (i) the sum of R', Cr and M must be at least 12 atom percent, and (ii) B represents at least 80 atom percent of the combined content of B, P, C and Si.

16. Alloy bodies according to claim 15 having a thickness of at least 0.2 millimeter, measured in the shortest dimension.

17. Alloy compositions according to claim 11 having the formula $$Fe_{30-80}Cr_{0-40}(Co,Ni)_{0-20}(Mo,W)_{0-20}B_{5-12}(P,C,Si)_{0-2.5}$$

wherein (i) the sum of Cr, Co, Ni, Mo and W is at least 10 atom percent; and (ii) when Mo and W represent less than 10 atom percent, then Cr must be at least 8 atom percent.

18. Alloy bodies according to claim 17 having a thickness of at least 0.2 millimeter, measured in the shortest dimension.

19. Alloy compositions according to claim 12 having the formula $$Co_{30-80}Cr_{0-40}(Fe,Ni)_{0-20}(Mo,W)_{0-15}B_{5-12}$$

wherein the sum of Cr, Fe, Ni, Mo and W is at least 10 atom percent.

20. Alloy compositions according to claim 19 containing at least about 25 atom percent of Cr.

21. Alloy bodies according to claim 19 having a thickness of at least 0.2 millimeter, measured in the shortest dimension.

22. Alloy compositions according to claim 11 having the formula $$Ni_{30-80}Cr_{0-45}(Fe,Co)_{0-25}(Mo,W)_{0-10}B_{5-12}$$

wherein the sum of Cr, Fe, Co, Mo and W is at least 10 atom percent.

23. Alloy compositions according to claim 22 containing at least about 25 atom percent of Cr.

24. Alloy bodies according to claim 22 having a thickness of at least 0.2 millimeter, measured in the shortest dimension.

25. Alloy compositions according to claim 11 having the formula $$Fe_{58-84}Cr_{5-15}Mo_{5-15}B_{5-10}(C,Si)_{1-5}.$$

26. Alloy bodies according to claim 25 having a thickness of at least about 0.2 millimeter, measured in the shortest dimension.

27. Alloy compositions according to claim 11 having the formula $$Fe_{30-85}Ni_{0-20}Cr_{0-20}(Al,Mo,W)_{5-25}B_{5-12}(P,C,Si)_{0-3}.$$

28. Alloy compositions according to claim 11 having the formula $$Ni_{30-85}Fe_{0-20}Cr_{0-20}(Al,Mo,W)_{5-25}B_{5-12}(P,C,Si)_{0.3}.$$

29. Alloy compositions according to claim 11 having the formula $$Ni_{48-75}Cr_{0-20}Mo_{20-30}B_{5-12}.$$

30. Alloy compositions according to claim 11 having the formula $$Ni_{30-80}Cr_{0-45}(Fe,Co)_{0-25}(Mo,W)_{0-10}B_{5-12}$$

wherein the sum of Cr, Fe, Co, Mo and W is at least 10 atom percent.

31. Alloy bodies according to claim 30 having a thickness of at least 0.2 millimeter, measured in the shortest dimension.

32. Iron-based, boron and carbon-containing transition metal alloys, containing at least two metal components, said alloys being composed of ultrafine grains of a primary solid solution phase randomly interspersed with particles of complex borides, wherein said complex boride particles are predominantly located at the junctions of at least three grains of said ultrafine grain solid solution phase, and wherein said ultrafine grains of said solid solution phase in turn are interspersed with carbide particles.

33. Alloys according to claim 32 which are subjected to heat treatment for about 0.01 to about 100 hours at a temperature of about 0.6 to about 0.95 of the alloy's solidus temperature in degrees centigrade, said temperature being above the crystalization temperature of the composition, to change their hardness and ductility.

34. Alloys according to claim 32 wherein said ultrafine grains of the primary solid solution phase have an average largest diameter of less than about 3 microns, and wherein said complex boride particles have an average largest diameter of less than about 1 micron, as viewed on a microphotograph of an electron microscope.

35. Alloys according to claim 32 having the composition $$Fe_m(Co,Ni)_nCr_pM_qB_rC_s(P,Si)_t$$

wherein (a) M is one or more of molybdenum, tungsten, vanadium, niobium, titanium, tantalum, aluminum, tin, germanium, antimony, beryllium, zirconium, manganese and copper;

(b) m, n, p, q, r, s and t are in atomic percent and have the following values:

$m=40-80$ $n=0-45$ $p=0-45$ $q=0-30$ $r=5-12$ $s=0.5-3$ $t=0-7.5$ with the provisos that (1) the sum of $n+p+q$ is at least 5; (2) when q is larger than 20, then p must be less than 20; and (3) the amount of each of vanadium, manganese, copper, tin, termaniumanium, and antimony may not exceed 10 atom percent.

36. Alloys according to claim 35 which are subjected to heat treatment for about 0.01 to about 100 hours at a temperature of about 0.6 to about 0.95 of the alloy's solidus temperature in degrees centigrade, said temperature being above the crystallization temperature of the composition, to change their hardness and ductility.

* * * * *